US010295922B2

(12) United States Patent
Terui et al.

(10) Patent No.: US 10,295,922 B2
(45) Date of Patent: May 21, 2019

(54) TONER AND TONER MANUFACTURING METHOD

(71) Applicant: CANON KABUSHIKI KAISHA, Tokyo (JP)

(72) Inventors: Yuhei Terui, Numazu (JP); Yu Yoshida, Mishima (JP); Haruko Kubo, Fukui (JP); Hitoshi Itabashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/457,305

(22) Filed: Mar. 13, 2017

(65) Prior Publication Data

US 2017/0269495 A1 Sep. 21, 2017

(30) Foreign Application Priority Data

Mar. 18, 2016 (JP) ..... 2016/055247

(51) Int. Cl.
*G03G 9/08* (2006.01)
*G03G 9/09* (2006.01)
*G03G 9/087* (2006.01)

(52) U.S. Cl.
CPC ..... *G03G 9/092* (2013.01); *G03G 9/0806* (2013.01); *G03G 9/08711* (2013.01); *G03G 9/08755* (2013.01); *G03G 9/0918* (2013.01)

(58) Field of Classification Search
CPC ..... G03G 9/0918
See application file for complete search history.

(56) References Cited

U.S. PATENT DOCUMENTS

| | | | |
|---|---|---|---|
| 5,494,770 | A | 2/1996 | Baba et al. |
| 5,573,880 | A | 11/1996 | Mayama et al. |
| 5,576,133 | A | 11/1996 | Baba et al. |
| 5,744,278 | A | 4/1998 | Ayaki et al. |
| 5,985,502 | A | 11/1999 | Ayaki et al. |
| 6,083,655 | A | 7/2000 | Itabashi et al. |
| 6,106,990 | A | 8/2000 | Tazawa et al. |
| 6,124,070 | A | 9/2000 | Baba et al. |
| 6,165,663 | A | 12/2000 | Baba et al. |
| 6,500,593 | B2 | 12/2002 | Abe et al. |
| 6,566,028 | B2 | 5/2003 | Tazawa et al. |
| 6,689,525 | B2 | 2/2004 | Itabashi |
| 6,790,576 | B2 | 9/2004 | Fujimoto et al. |
| 6,808,855 | B2 | 10/2004 | Ayaki et al. |
| 7,323,282 | B2 | 1/2008 | Ohno et al. |
| 8,053,156 | B2 | 11/2011 | Abe et al. |
| 8,178,275 | B2 | 5/2012 | Tani et al. |
| 8,383,312 | B2 | 2/2013 | Fujimoto et al. |
| 8,440,382 | B2 | 5/2013 | Isono et al. |
| 8,497,054 | B2 | 7/2013 | Sugiyama et al. |
| 8,574,801 | B2 | 11/2013 | Itabashi et al. |
| 8,609,312 | B2 | 12/2013 | Itabashi et al. |
| 8,652,725 | B2 | 2/2014 | Watanabe et al. |
| 8,652,737 | B2 | 2/2014 | Handa et al. |
| 8,778,581 | B2 | 7/2014 | Nonaka et al. |
| 8,828,633 | B2 | 9/2014 | Itabashi et al. |
| 8,883,946 | B2 | 11/2014 | Yasumatsu et al. |
| 8,916,319 | B2 | 12/2014 | Ikeda et al. |
| 8,940,467 | B2 | 1/2015 | Hashimoto et al. |
| 8,975,000 | B2 | 3/2015 | Tani et al. |
| 9,029,056 | B2 | 5/2015 | Kenmoku et al. |
| 9,079,989 | B2 | 7/2015 | Yasumatsu et al. |
| 9,098,002 | B2 | 8/2015 | Kenmoku et al. |
| 9,098,003 | B2 | 8/2015 | Masumoto et al. |
| 9,158,216 | B2 | 10/2015 | Shinano et al. |
| 9,229,345 | B2 | 1/2016 | Ikeda et al. |
| 9,377,705 | B2 | 6/2016 | Shimano et al. |
| 9,383,668 | B2 | 7/2016 | Noji et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 2004/0185362 | A1* | 9/2004 | Arthur ..... G03G 9/0918 430/108.21 |
| 2012/0172562 | A1 | 7/2012 | Kenmoku et al. |
| 2013/0065174 | A1 | 3/2013 | Itabashi et al. |

(Continued)

FOREIGN PATENT DOCUMENTS

| | | | | |
|---|---|---|---|---|
| JP | 63248864 | A | 10/1988 | |
| JP | 63270060 | A | 11/1988 | |
| JP | 06-214426 | * | 8/1994 | ..... G03G 9/09 |
| JP | 2004045654 | A | 2/2004 | |
| JP | 2005181835 | A | 7/2005 | |
| JP | 2005-215501 | A | 8/2005 | |
| JP | 2007131832 | A | 5/2007 | |
| JP | 4097312 | B2 | 6/2008 | |
| JP | 4361676 | B2 | 11/2009 | |
| JP | 4484171 | B2 | 6/2010 | |
| JP | 2012133192 | A | 7/2012 | |

(Continued)

OTHER PUBLICATIONS

Translation of JP 06-214426 published Aug. 1994.*
U.S. Appl. No. 15/456,833, filed Mar. 13, 2017.
U.S. Appl. No. 15/456,989, filed Mar. 13, 2017.
U.S. Appl. No. 15/457,054, filed Mar. 13, 2017.

*Primary Examiner* — Peter L Vajda
(74) *Attorney, Agent, or Firm* — Venable LLP

(57) ABSTRACT

A toner containing a toner particle including a binder resin, a resin A having a pKa of 6.0-9.0, and a pigment having a pKb of 4.0-7.0, wherein the pKa is an acid dissociation constant measured by preparing a resin solution in which 1.0 part by mass of the resin A, 70.0 parts by mass of toluene and 30.0 parts by mass of ethanol are mixed, and carrying out neutralization titration with a potassium hydroxide ethanol solution of 0.1 mol/L, and the pKb is a basic dissociation constant measured by preparing a pigment dispersion in which 10.0 parts by mass of the pigment, 140.0 parts by mass of toluene and 60.0 parts by mass of ethanol are mixed, and carrying out neutralization titration with a hydrochloric acid ethanol solution of 0.1 mol/L.

19 Claims, No Drawings

(56) References Cited

U.S. PATENT DOCUMENTS

| | | | | |
|---|---|---|---|---|
| 2015/0099220 | A1 | 4/2015 | Abe et al. | |
| 2015/0099222 | A1 | 4/2015 | Terui et al. | |
| 2015/0153669 | A1 | 6/2015 | Yoshida et al. | |
| 2015/0286157 | A1 * | 10/2015 | Masumoto ..... | G03G 9/081<br>430/108.4 |
| 2015/0370189 | A1 | 12/2015 | Tanaka et al. | |
| 2016/0246192 | A1 | 8/2016 | Yoshida et al. | |
| 2016/0349646 | A1 | 12/2016 | Yoshida et al. | |
| 2017/0052465 | A1 | 2/2017 | Shimano et al. | |

FOREIGN PATENT DOCUMENTS

| | | | |
|---|---|---|---|
| JP | 2012256044 | A | 12/2012 |
| JP | 2014222356 | A | 11/2014 |
| JP | 2015125406 | A | 7/2015 |
| JP | 2015148731 | A | 8/2015 |

* cited by examiner

TONER AND TONER MANUFACTURING METHOD

BACKGROUND OF THE INVENTION

Field of the Invention

The present invention relates to a toner for developing electrostatic images used in image-forming methods such as electrophotography and electrostatic printing, and to a toner manufacturing method.

Description of the Related Art

There have been many recent advances in the electrophotographic technologies used in printers, copiers and the like, and the devices are now expected to be lighter, smaller and more energy efficient. There is also strong demand for toners that provide good image reproducibility with high image quality and definition. To meet these demands, pigment dispersibility needs to be improved to improve the tinting strength of the toner.

As one means of improving tinting strength, Japanese Patent Application Laid-open No. 2005-215501 proposes increasing the amount of a colorant in the toner.

Methods are also known for improving tinting strength by improving pigment dispersibility. Pigment dispersants are used for this purpose, and many pigment dispersants are being developed. Japanese Patent Application Laid-open No. 2005-181835 proposes a pigment dispersant that exploits the acid-base interaction between the pigment and the pigment dispersant. The use of pigment derivatives has also been proposed as a means of improving the self-dispersibility of the pigment itself. Japanese Patent No. 4361676 proposes obtaining a fine pigment by a grinding process using a phthalocyanine derivative from phthalimide.

SUMMARY OF THE INVENTION

However, in the toner described in Japanese Patent Application Laid-open No. 2005-215501, further improvements in tinting strength were not obtained when the amount of the colorant was further increased in order to increase the tinting strength.

With the pigment dispersant described in Japanese Patent Application Laid-open No. 2005-181835, although pigment dispersibility was improved, the desired level of tinting strength was not obtained because the high polarity of the pigment dispersant caused the pigment to aggregate in the toner particle.

When the fine pigment described in Japanese Patent 4361676 was applied to a toner, dispersibility was in fact improved, but in many cases adequate tinting strength was not achieved using the pigment derivative by itself. Moreover, in some cases toner transferability was reduced when using the pigment derivative, detracting from image reproducibility. When a pigment dispersant was added to the pigment derivative as in Japanese Patent Application Laid-open No. 2005-181835 in an effort toward further improvement, the problems described above still persisted, and there was room for further improvement.

The present invention provides a toner with excellent tinting strength and transferability, along with a toner manufacturing method.

As a result of earnest study aimed at solving the problem, the inventors discovered that the problem could be solved with a toner containing a resin A having a specific acid dissociation constant pKa and a pigment having a specific base dissociation constant pKb.

That is, the present invention is a toner comprising a toner particle containing a binder resin, a resin A having a pKa of at least 6.0 and not more than 9.0, and a pigment having a pKb of at least 4.0 and not more than 7.0, wherein the pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a potassium hydroxide ethanol solution of 0.1 mol/L, and the pKb represents a basic dissociation constant measured by preparing a pigment dispersion in which 10.0 parts by mass of the pigment, 140.0 parts by mass of toluene and 60.0 parts by mass of ethanol are mixed, and carrying out neutralization titration with a hydrochloric acid ethanol solution of 0.1 mol/L.

The present invention also relates to a method for manufacturing the aforementioned toner, wherein the toner manufacturing process comprises either step (i) or step (ii) below:

(i) a step of forming, in an aqueous medium, a particle of a polymerizable monomer composition containing the pigment, the resin A and a polymerizable monomer capable of producing the binder resin, and then polymerizing the polymerizable monomer contained in the particle of the polymerizable monomer composition;

(ii) a step of forming, in an aqueous medium, a particle of a resin solution obtained by dissolving or dispersing the binder resin, the resin A and the pigment in an organic solvent, and then removing the organic solvent contained in the particle of the resin solution.

The present invention also relates to a toner comprising a toner particle containing a binder resin, a resin A and a pigment, wherein the pigment contains an organic dye having a basic segment, and the organic dye having the basic segment has a structure represented by Formula (1) below:

(1)

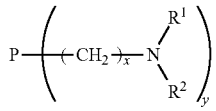

[in Formula (1), P represents an organic dye, x is 1 or 2, y is at least 1 and not more than 4, and each of $R^1$ and $R^2$ is independently a hydrogen atom, linear or branched alkyl group, or a group necessary for forming a heterocycle in which $R^1$ and $R^2$ bind together], and the resin A has a structure represented by Formula (3) below:

(3)

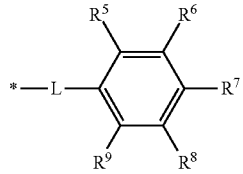

[In Formula (3), either RE or $R^7$ is a carboxy group, while each of the $R^5$, $R^6$, $R^1$, $R^6$ and $R^9$ other than the carboxy group is independently a hydrogen atom, hydroxy group, amino group, $C_{1-8}$ alkoxy group or $C_{1-8}$ alkyl group, L is a linking group represented by the following Formula (4), and * is a segment binding to the main chain skeleton of the resin A], (4)

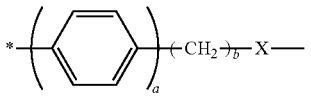

[in Formula (4), a is 0 or 1, b is an integer at least 0 and not greater than 4, X is a single bond or a group represented by —O—, —S— or —$NR^{10}$—, $R^{10}$ is a hydrogen atom or $C_{1-4}$ alkyl group, and * is a segment binding to the main chain skeleton of the resin A].

Further features of the present invention will become apparent from the following description of exemplary embodiments.

DESCRIPTION OF THE EMBODIMENTS

Embodiments of the present invention are explained below, but the present invention is not limited to these embodiments.

Unless specifically indicated otherwise, for the present invention phrases such as "at least XX and not more than YY" and "XX-YY" that indicate a range of numerical values denote a numerical value range that includes the lower limit and upper limit that are the end points.

The mechanism by which the effects of the invention are obtained is not clearly known, but may be as follows.

In the present invention, the pKa of the resin A is measured by titration with a basic solution in an organic solvent, meaning that the resin A behaves as acidic when the pH in the organic solvent is at or below the pKa.

Similarly, the pKb of the pigment is measured by using an acidic solution to titrate the pigment dispersed in an organic medium, meaning that the pigment behaves as basic when the pH in the organic solvent is at or above the pKb.

Thus, it is thought that a strong interaction occurs between the resin A with this acidic property and the pigment with this basic property. The resin A having the pKa described above exhibits a strong adsorbability with respect to the pigment having the pKb described above. As a result, it is thought that the dispersibility of the pigment is greatly enhanced by steric hindrance generated by the resin between the pigment particles.

Moreover, it is thought that the acidic resin A also improves transferability because it neutralizes the polarity of the basic pigment when the resin is adsorbed by the pigment.

When the pKa of the resin A is at least 6.0 and not more than 9.0, it exhibits strong interactivity with the pigment because it is sufficiently acidic even in the basic range, leading to excellent tinting strength and transferability. When the pKa is below 6.0, interactivity with the pigment is weaker because acid dissociability is weaker in the basic range. When the pKa is over 9.0, on the other hand, the interactivity between the pigment and the dissociated resin A is weaker because the acid dissociability is too strong.

In the present invention, the pKa of the resin A is preferably at least 6.5 and not more than 8.5, or more preferably at least 7.0 and not more than 8.0.

The pKa is the acid dissociation constant measured by mixing 1.0 mass parts of the resin A, 70.0 mass parts of toluene and 30.0 mass parts of ethanol to prepare a resin solution that is then subjected to neutralization titration with a 0.1 mol/L potassium hydroxide ethanol solution.

Similarly, when the pKb of the pigment is at least 4.0 and not more than 7.0, it exhibits strong interactivity with the resin A because it is sufficiently basic even in the acidic range, leading to excellent tinting strength and transferability. When the pKb is below 4.0, the base dissociability of the pigment is too strong in the acidic range, leading to withdrawal of hydrogen from the resin A and weaker interactivity with the resin A itself. When the pKb is over 7.0, on the other hand, interactivity with the resin A is weaker due to the weaker base dissociability in the acidic range. In the present invention, the pKb of the pigment is preferably at least 4.3 and not more than 6.7, or more preferably at least 4.5 and not more than 6.5.

The pKb is the base dissociation constant measured by mixing 10.0 mass parts of the pigment, 140.0 mass parts of toluene and 60.0 mass parts of ethanol to prepare a pigment dispersion that is then subjected to neutralization titration with a 0.1 mol/L hydrochloric acid ethanol solution.

In the invention, the pigment is preferably a surface-treated pigment having basic segments on the surface. Specifically, it is preferably a pigment containing an organic dye having basic segments, or a pigment having a basic functional group (hereunder sometimes called a "basic-treated pigment" or "treated pigment"). When the pigment is a pigment containing an organic dye having basic segments, the organic dye having the basic segment preferably has a structure represented by Formula (1) below.

Formula (1)

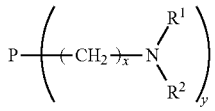

[In Formula (1), P represents an organic dye, x is 1 or 2, y is at least 1 and not more than 4, and each of $R^1$ and $R^2$ is independently a hydrogen atom, linear or branched alkyl group, or a group necessary for forming a (preferably $C_{3-6}$) heterocycle in which $R^1$ and $R^2$ bind together.]

Preferably P is an organic dye, and is a structure that is adsorbable by the pigment. The structure that is adsorbable by the pigment is preferably a pigment derivative skeleton, or more preferably a pigment with strong π planarity.

Specific examples of pigment derivatives with strong π planarity include carbon black derivatives, phthalocyanine skeletons, quinacridone skeletons, pyrrolopyrrole skeletons, dioxazine skeletons and the like. From the standpoint of versatility and the like, phthalocyanine skeletons and quinacridone skeletons are desirable.

More preferably, P is an organic dye having a phthalocyanine skeleton or quinacridone skeleton. Specific examples include copper phthalocyanine, 2,9-dimethylquinacridone, unsubstituted quinacridone and the like.

In particular, a structure in which each of $R^1$ and $R^2$ is independently a hydrogen atom, $C_{1-4}$ linear or branched alkyl group, or a heterocycle (such as a 5-member ring) in which $R^1$ and $R^2$ bind together, is desirable for controlling steric hindrance and facilitating adsorption of the resin A. When $R^1$ and $R^2$ bind together to form a heterocycle, a nitrogen atom or oxygen atom may be included in the ring structure in addition to the N in Formula (1).

y represents the average number of basic segments bound to the organic dye (average per molecule of organic dye). For purposes of improving the adsorption rate by the resin A, y is at least 1 and not more than 4, or preferably at least 2 and not more than 3.

The following are specific examples of basic compounds corresponding to —$NR^1R^2$ above: an amino group as a primary amine, monomethylamino group, monoethylamino group, monopropylamino group, monoisopropylamino group, monobutylamino group, monoisobutylamino group, mono-tert-butylamino group, monopentylamino group and monohexylamino group as secondary amines, and dimethylamino group, diethylamino group, dipropylamino group, diisopropylamino group, dibutylamino group, diisobutylamino group, di-tert-butylamino group, dipentylamino group, dihexylamino group, methylethylamino group, methylpropylamino group, methylbutylamino group, ethylpropylamino group, ethylbutylamino group, pyrrolidinyl group, piperidinyl group, piperadinyl group, morpholino group, pyrrolyl group and phthalimido group as tertiary amines.

Of these, a $C_{1-4}$ dialkylamine structure or $C_{3-6}$ cyclic amine structure is preferred. This makes it easier to maintain the pKb of the pigment within the desired range.

The method of preparing the organic dye having the basic segments is not particularly limited, and it can be obtained by conventional known methods. Specifically, the methods described in Japanese Patent No. 4484171 may be adopted.

When the pigment in the present invention is a pigment having a basic functional group, the basic functional group is preferably a group represented by Formula (2) below.

Formula (2)

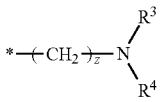

[In Formula (2), * represents a segment binding with the pigment, z is 1 or 2, and each of $R^3$ and $R^4$ is independently a hydrogen atom, linear or branched alkyl group, or a group necessary for forming a (preferably $C_{3-6}$) heterocycle in which $R^3$ and $R^4$ bind together].

Preferred embodiments of $R^3$ and $R^4$ are similar to those given for $R^1$ and $R^2$ above. The same applies to the group represented by —$NR^3R^4$, which is similar to the functional group represented by —$NR^1R^2$ above.

A pigment having a basic functional group can be obtained for example by direct chemical modification that partially basifies the pigment. As a specific method, a phthalocyanine pigment can be reacted in concentrated sulfuric acid with paraformaldehye and phthalimide to obtain a basified copper phthalocyanine.

The conventional known substances listed below are examples of the pigment base or organic dye. Examples of black pigments include carbon black and the like.

Examples of yellow pigments include condensation pigments, isoindolinone compounds, anthraquinone compounds, azo metal complex methine compounds, allylamide compounds and the like. More specific examples include C. I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199.

Examples of magenta pigments include condensation pigments, diketopyrrolopyrrole compounds, anthraquinone compounds, quinacridone compounds, basic dye lake compounds, naphthol compounds, benzimidazolone compounds, thioindigo compounds and peryline compounds. More specific examples include C. I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269, and C. I. Pigment Violet 19 and the like.

Examples of cyan pigments include phthalocyanine compounds, derivatives of phthalocyanine compounds, anthraquinone compounds, basic dye lake compounds and the like. More specific examples include C. I. Pigment Blue 1, 7, 15, 15:1, 15:2, 15:3, 15:4, 60, 62 and 66.

One of these compounds may be used individually, or two or more may be combined. Moreover, one kind of pigment base or organic dye or a combination of two or more may also be mixed with a compound having the basic segments or basic functional group described above.

One pigment obtained by these methods may be used alone, or a combination of two or more may be used.

In the invention, the base value of the pigment is preferably at least 0.9 mgKOH/g and not more than 3.0 mgKOH/g, or more preferably at least 1.3 mgKOH/g and not more than 2.5 mgKOH/g.

When the base value of the pigment is at least 0.9 mgKOH/g, pigment dispersibility is improved because there is a sufficient quantity of the basic segments or basic functional groups, resulting in improved tinting strength.

On the other hand, the base value of the pigment is preferably not more than 3.0 mgKOH/g in order to avoid adverse effects on the other toner properties while maintaining adequate tinting strength.

The base value of the pigment can be controlled by adjusting the mixed amounts of the pigment base or organic dye and the compound having basic segments or basic functional groups. The method of measuring the base value is described below.

In order to obtain superior color reproducibility and image reproducibility, the content of the pigment in the invention is preferably at least 2.0 mass % and not more than 15.0 mass %, or more preferably at least 3.0 mass % and not more than 12.5 mass % of the toner particle.

Next, the resin A used in the invention is explained in detail.

In the present invention, the hydrophobic parameter HPA of the resin A is preferably at least 0.65 and not more than 0.98, or more preferably at least 0.65 and not more than 0.95.

The hydrophobic parameter HPA is the volume fraction of heptane at a point of precipitation by the resin A as measured by the addition of heptane to a solution containing 0.01 mass parts of the resin A and 1.48 mass parts of chloroform.

When the hydrophobic parameter HPA is 0.65 or more, pigment dispersibility can be improved by increasing the hydrophobicity of the pigment surfaces with the adsorbed resin A, thereby improving the tinting strength and transferability of the toner.

The method of controlling the hydrophobic parameter HPA is explained in detail below, but it can be controlled by means of the structure of the functional group of the resin A, the number of functional groups and the structure of the main chain.

The acid value of the resin A is preferably at least 3.0 mgKOH/g and not more than 25.0 mgKOH/g, or more preferably at least 5.0 mgKOH/g and not more than 20.0 mgKOH/g.

When the acid value of the resin A is at least 3.0 mgKOH/g, the tinting strength and transferability can be easily improved because the resin A interacts sufficiently with the pigment. When the acid value of the resin A is not more than 25.0 mgKOH/g, on the other hand, the hydrophobic parameter can be easily controlled because there is little hydrophilicity originating in the functional groups of the resin A.

The content of the resin A is preferably at least 1.0 mass part and not more than 30.0 mass parts, or more preferably at least 3.0 mass parts and not more than 30.0 mass parts, or still more preferably at least 5.0 mass parts and not more than 25.0 mass parts per 100 mass parts of the pigment.

When the content of the resin A is at least 1.0 mass part, it is easy to improve the tinting strength and transferability because a sufficient amount of the resin A interacts with the pigment. When the content is 30.0 mass parts or less, on the other hand, it is easy to improve the tinting strength because it is easier to control pigment aggregation caused by components that have not been adsorbed by the pigment.

The resin A preferably has an acidic functional group in the invention.

When the resin A has an acidic functional group, the acidic functional group interacts with the basic segment or basic functional group of the pigment, resulting in high adsorbability by the pigment. It is thus possible to greatly improve the tinting strength and transferability of the toner.

The acidic functional group may be a carboxy group, sulfo group, phosphoric acid group, or a phenolic hydroxy group or the like.

Of these acidic functional groups, a carboxy group, sulfo group or phosphoric acid group is preferred because it is highly acidic and advantageous for adsorption to a basic segment or basic functional group. A carboxy group or sulfo group is preferred from the standpoint of ease of manufacture and stability of the resin A.

The resin A preferably has a structure represented by Formula (3) below in the invention.

Formula (3)

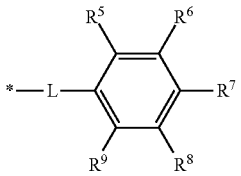

[In Formula (3), either $R^6$ or $R^7$ is a carboxy group, while each of the $R^5$, $R^6$, $R^7$, $R^8$, and $R^9$ other than the carboxy group is independently a hydrogen atom, hydroxy group, amino group, $C_{1-8}$ alkoxy group or $C_{1-8}$ alkyl group, L is the linking group represented by the following Formula (4), and * is a segment binding to the main chain skeleton of the resin A.]

Formula (4)

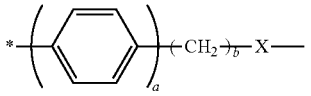

[In Formula (4), a is 0 or 1, b is an integer that is at least 0 and not more than 4, X is a single bond or a group represented by —O—, —S— or —$NR^{10}$—, $R^{10}$ is a hydrogen atom or $C_{1-4}$ alkyl group, and * is a segment binding to the main chain skeleton of the resin A.]

The carboxy group in Formula (3) is a segment that interacts with the pigment, and preferably either one of $R^6$ and $R^7$ is a carboxy group. When either one of $R^6$ and $R^7$ is a carboxy group, steric hindrance can be reduced in interactions with the pigment because there is more distance with the main chain skeleton of the resin A. When $C_{1-8}$ alkoxy groups or $C_{1-8}$ alkyl groups are used as the groups other than the carboxy group, $C_{1-4}$ alkoxy groups or $C_{1-4}$ alkyl groups are preferred from the standpoint of steric hindrance in interactions with the pigment.

The a in Formula (4) is preferably 1. When a is 1, interaction with the pigment can be easily improved because the distance with the main chain skeleton of the resin A can be controlled at a suitable distance. For similar reasons, b is preferably at least 1 and not more than 4. When X is —O—, the electron donating property is increased, which is desirable for further increasing the pKa in conjunction with the carboxy group of Formula (3).

The structure represented by Formula (3) above is preferably a structure represented by Formula (5) below.

Formula (5)

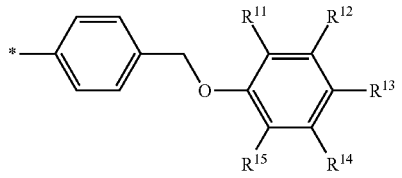

[In Formula (5), one of $R^{12}$ and $R^{13}$ is a carboxy group, while the other is a hydroxy group, and each of $R^{11}$, $R^{14}$ and $R^{15}$ is independently a hydrogen atom, hydroxy group, amino group, $C_{1-8}$ alkoxy group or $C_{1-8}$ alkyl group, and * is a segment binding to the main chain skeleton of the resin A.]

In addition to the reasons given above, the structure represented by Formula (3) above is preferably the structure represented by Formula (5) above in order to further increase the pKa by means of the electron donating effect of the hydroxy group in conjunction with the carboxy group of Formula (3).

The main chain skeleton of resin A may be any kind of polymer. For example, it may be a vinyl polymer, polyester polymer, polyamide polymer, polyurethane polymer, polyether polymer or the like.

Of these, a vinyl polymer or polyester polymer is preferred from the standpoint of ease of manufacture. A vinyl polymer is especially desirable to facilitate hydrophobic parameter control. When a vinyl polymer is used as the main chain skeleton of the resin A in the invention, it can be obtained for example by copolymerizing a vinyl monomer with a compound having an introduced polymerizable functional group represented by Formula (6) below for example, or by introducing an acidic function group into a polymer that has previously been co-polymerized from a monomer derived from the main chain skeleton.

Formula (6)

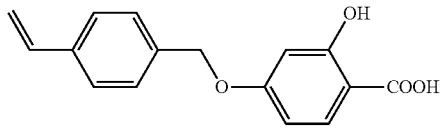

A known monomer may be used as the vinyl monomer in the main chain skeleton of the resin A, without any particular limitations.

Specific examples include aromatic vinyl monomers such as styrene, o-methylstyrene, m-methylstyrene, p-methylstyrene and α-methylstyrene; unsaturated monoolefin monomers such as ethylene, propylene, butylene and isobutylene; halogenated vinyl monomers such as vinyl chloride, vinylidene chloride, vinyl bromide and vinyl fluoride; vinyl ester acid monomers such as vinyl acetate, vinyl propionate and vinyl benzoate; acrylic acid monomers such as acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate and benzyl acrylate; and methacrylic acid monomers such as methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate and benzyl methacrylate. One of these monomers may be used alone, or two or more may be combined.

A composite polymer comprising a polyester polymer and a vinyl polymer is also possible as the main chain skeleton of the resin A. Specific examples include composite polymers obtained by grafting vinyl polymers to polyester polymer main chains, and composite polymers having structures obtained by binding blocks of polyester polymers and vinyl polymers together.

For purposes of controlling the hydrophobic parameter HPA of the resin A, the resin A also preferably has an alkoxycarbonyl group represented by Formula (7).

Formula (7)

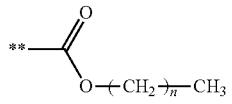

In Formula (7), n is preferably an integer that is at least 3 and not more than 21. When n is at least 3, it is easy to control the hydrophobic parameter HPA of the resin A, while when n is not more than 21, there is no effect on steric hindrance when the acidic functional group of the resin A interacts by acid-base interaction with the basic functional group of the pigment. ** represents a segment binding to the main chain skeleton of the resin A.

An alkyl ester of a $C_{3-21}$ acrylic acid or methacrylic acid is preferred as a monomer having such a structure represented by Formula (7), or in other words having an alkoxycarbonyl group. Examples include butyl acrylate, stearyl acrylate, behenyl acrylate, butyl methacrylate, stearyl methacrylate and behenyl methacrylate. The content of the monomer unit containing the structure of Formula (7) is preferably at least 1 mol % and not more than 30 mol %, or more preferably at least 2 mol % and not more 10 mol % based on the total monomer units making up the resin A.

The weight-average molecular weight (Mw) of the resin A is preferably at least 10,000 and not more than 75,000, or more preferably at least 12,000 and not more than 55,000.

When the Mw is at least 10,000, acid dissociation is less likely because the molecules of resin A are sufficiently large. This means that the pKa is likely to be higher.

When the Mw is not more than 75,000, on the other hand, it is easier to form a molecular structure suitable for interacting with the pigment, and the resin A can exhibit high adsorbability by the pigment.

The Mw of the resin A can be controlled by changing the reaction temperature during polymerization, the reaction time, the charging ratio of the monomers, and the amount of the initiator and the like.

The method of manufacturing the toner of the invention is explained next.

The toner of the invention can be manufactured by conventional known methods.

Examples include a suspension polymerization method in which a polymerizable monomer composition containing a polymerizable monomer for producing a binder resin, a pigment, and a resin A and together with a release agent and the like as necessary is suspended in an aqueous medium, and the polymerizable monomer is polymerized; a kneading pulverization method in which a toner-forming material containing a binder resin, a resin A and a pigment is kneaded, pulverized and sorted; an emulsion aggregation method in which a dispersion of an emulsified and dispersed binder resin, a dispersion of an emulsified and dispersed resin A and a pigment dispersion are mixed together with a dispersion of a release agent or the like as necessary, aggregated, and heat fused to obtain a toner particle; an emulsion polymerization and aggregation method in which a dispersion formed by emulsion polymerization of the polymerizable monomer of a binder resin is mixed with a dispersion of an emulsified and dispersed resin A and a pigment dispersion together with a dispersion of a release agent or the like as necessary, and then aggregated and heat fused to obtain a toner particle; and a dissolution suspension method in which a binder resin, a resin A and a pigment are dissolved or dispersed in an organic solvent together with a release agent or the like as necessary to obtain a resin solution which is then suspended in an aqueous medium, and granulated.

In particular, with a manufacturing method that includes a step of uniformly mixing a toner composition in an oil phase, the dispersibility of the pigment in the toner particle is improved because the binder resin, resin A and pigment are uniformly mixed. Therefore, in the present invention the toner manufacturing process preferably includes either step (i) or step (ii) below:

(i) a step of forming, in an aqueous medium, a particle of a polymerizable monomer composition containing the pigment, the resin A and a polymerizable monomer capable of producing the binder resin, and then polymerizing the polymerizable monomer contained in the particle of the polymerizable monomer composition;

(ii) a step of forming, in an aqueous medium, a particle of a resin solution obtained by dissolving or dispersing the binder resin, the resin A and the pigment in an organic solvent, and then removing the organic solvent contained in the particle of the resin solution.

A vinyl polymer, polyester polymer, polyamide polymer, polyurethane polymer or polyether polymer or the like may be used as the binder resin.

Of these, a vinyl polymer or polyester polymer is preferred for ease of manufacture.

The vinyl polymer is a resin obtained by polymerizing a radical-polymerizable vinyl monomer.

Examples of vinyl monomers include styrenes and styrene derivatives such as styrene, α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

polymerizable acrylic monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate and 2-benzoyloxy ethyl acrylate; and polymerizable methacrylic monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethylphosphate ethyl methacrylate and dibutylphosphate ethyl methacrylate.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylol propane trimethacrylate, tetramethylol methane tetramethacrylate, divinyl benzene, divinyl naphthalene and divinyl ether.

These may be used individually, or two or more may be combined.

Examples of monomers that can be used in the polyester polymer include polyvalent carboxylic acids and polyhydric alcohols.

Examples of polyvalent carboxylic acids include oxalic acid, glutaric acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid and cyclohexane dicarboxylic acid. Examples of polyvalent carboxylic acids other than dicarboxylic acids include trimellitic acid, pyromellitic acid, naphthalene tricarboxylic acid, naphthalene tetracarboxylic acid, pyrene tricarboxylic acid and pyrene tetracarboxylic acid.

Examples of polyhydric alcohols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethylbenzene, bisphenol A, bisphenol A ethylene oxide adduct, bisphenol A propylene oxide adduct, hydrogenated bisphenol A, hydrogenated bisphenol A ethylene oxide adduct, hydrogenated bisphenol A propylene oxide adduct and the like.

The toner of the invention may also contain a release agent.

Examples of the release agent include aliphatic hydrocarbon waxes such as low-molecular-weight polyethylene, low-molecular-weight polypropylene, microcrystalline wax and paraffin wax; aliphatic hydrocarbon wax oxides such as polyethylene oxide wax; block copolymers of aliphatic hydrocarbon waxes; waxes consisting primary of fatty acid esters, such as carnauba wax, sasol wax and montanic acid ester wax; partially or fully deoxidized fatty acid esters, such as deoxidized carnauba wax; partial esterification products of fatty acids and polyhydric alcohols, such as behenic acid monoglyceride; and methyl ester compounds with hydroxy groups obtained by hydrogenation of plant-based oils and fats.

The content of the release agent in the toner particle is preferably at least 3.0 mass % and not more than 12.0 mass %.

The toner of the present invention may also contain a charge control agent. A conventional known charge control agent may be used as the charge control agent.

Examples of negative charge control agents include metal compounds of aromatic carboxylic acids such as salicylic acid, alkylsalicylic acid, dialkyl salicylic acid, naphthoic acid and dicarboxylic acid; polymers or copolymers having sulfonic acid groups, sulfonate groups or sulfonic acid ester groups; metal salts or metal complexes of azo dyes or azo pigments; and boron compounds, silicon compounds and calixarenes.

Examples of positive charge control agents include quaternary ammonium salts and polymeric compounds having quaternary ammonium salts in the side chains; and guanidine compounds, nigrosine compounds and imidazole compounds.

Monopolymers of vinyl monomers containing sulfonic acid groups, such as styrenesulfonic acid, 2-acrylamido-2-methylpropane sulfonic acid, 2-methacrylamido-2-methylpropane sulfonic acid, vinylsulfonic acid and methacrylsulfonic acid, or copolymers of other vinyl monomers with these vinyl monomers having sulfonic acid groups, can be used as polymers or copolymers having sulfonic acid groups, sulfonate groups or sulfonic acid ester groups. The content of the charge control agent in the toner particle is preferably at least 0.01 mass % and not more than 5.0 mass %.

An external additive may be added externally to the toner particle in the present invention to improve the image quality of the toner. Inorganic fine particles such as silica fine particles, titanium oxide fine particles or aluminum oxide fine particles can be used favorably as the external additive. These inorganic fine particles have preferably been hydrophobically treated with a silane coupling agent, silicone oil or a mixture of these as a hydrophobizing agent. An external additive other than those described above may also be mixed with the toner particle as necessary in the toner of the invention.

The methods of evaluating the various physical properties in the invention are explained next.

(Pigment Structure (NMR))

The structure of the pigment, such as the average number of basic segments bound to the organic dye, is analyzed by nuclear magnetic resonance spectroscopy ($^1$H-NMR).

Measurement equipment: JNM-EX400 (JEOL Ltd.)
Measurement frequency: 400 MHz
Pulse conditions: 5.0 μs
Frequency range: 10,500 Hz
Cumulative number: 1024
Measurement solvent: DMSO-d6

The sample was dissolved as much as possible in DMSO-d6, and measurement performed under the above conditions. The structure of the sample, such as the average number of basic segments and the like, was calculated from the proton ratio and chemical shift value of the resulting spectrum.

(Method for Measuring Hydrophobic Parameter HPA)

The hydrophobic parameter HPA is measured as follows.

0.01 g of the resin A is weighed into a 8 mL sample jar and dissolved in 1.48 g (1.0 mL) of chloroform, and the initial mass (W1) is measured.

A stir bar is placed in the sample jar, and the mixture is stirred with a magnetic stirrer while:

(a) 100 mg of heptane is added dropwise, and stirring is continued for 20 seconds;

(b) white turbidity is confirmed with the naked eye.

If there is no white turbidity, operations (a) and (b) are repeated. Once white turbidity is confirmed (deposition point), the operation is stopped, and the mass (W2) is measured. All measurements are performed at 25° C., normal pressure (1 atm).

The hydrophobic parameter HPA is calculated by the following formula. The specific gravity of heptane at 25° C., 1 atm is 0.684 g/mL, and the specific gravity of chloroform is 1.48 g/mL.

$$\text{Hydrophobic parameter HPA}=\{(W2-W1)/0.684\}/\{((W2-W1)/0.684)+1\}$$

The same measurement is performed three times, and the average value given as the hydrophobic parameter HPA.

(Method for Measuring Weight-Average Molecular Weight and Number-Average Molecular Weight of Resin)

The weight-average molecular weight (Mw) and number-average molecular weight (Mn) were measured as follows by gel permeation chromatography (GPC).

First, the resin was dissolved at room temperature in tetrahydrofuran (THF). The resulting solution was then filtered with a 0.2 μm pore diameter solvent-resistant membrane filter (Sample Pretreatment Cartridge, Tosoh Corporation) to obtain a sample solution. The concentration of THF-soluble components in the sample solution was adjusted to 0.8 mass %. Measurement was performed under the following conditions using this sample solution.

Equipment: High Performance GPC System "HLC-8220GPC" (Tosoh Corporation)
Columns: LF-604×2 (Showa Denko K.K.)
Eluent: THF
Flow rate: 0.6 mL/min
Oven temperature: 40° C.
Sample injection volume: 0.020 mL A molecular weight calibration curve prepared using standard polystyrene resin (for example product name "TSK standard polystyrene F-850, F-450, F-288, F-128, F-80, F-40, F-20, F-10, F-4, F-2, F-1, A-5000, A-2500, A-1000, A-500" (Tosoh Corporation)) was used for calculating the molecular weight of the sample.

(Method for Measuring Acid Value and pKa of Resin A)

The acid value is the number of mg of potassium hydroxide needed to neutralize the acid contained in 1 g of sample. The acid value in the present invention is measured in accordance with JIS K 0070-1992, and specifically is measured by the following procedures.

Titration is performed using a 0.1 mol/L potassium hydroxide ethanol solution (manufactured by Kishida Chemical Co., Ltd.). The factor of the potassium hydroxide ethanol solution can be determined using a potentiometric titrator (AT-510 potentiometric titrator manufactured by Kyoto Electronics Manufacturing Co., Ltd.).

100 mL of 0.1 mol/L hydrochloric acid is taken in a 250 mL tall beaker and titrated with the previous potassium hydroxide ethanol solution, and the value is determined from the amount of potassium hydroxide ethanol solution required for neutralization. The 0.1 mol/L hydrochloride acid is prepared in accordance with JIS K 8001-1998.

The measurement conditions for measuring acid value are given below.

Titration unit: AT-510 potentiometric titrator (Kyoto Electronics Manufacturing Co., Ltd.)

Electrodes: Composite glass electrode double-junction type (Kyoto Electronics Manufacturing Co., Ltd.)

Control software for titration unit: AT-WIN

Titration analysis software: Tview

The titration parameters and control parameters for titration are set as follows.

(Titration Parameters)

Titration mode: Blank titration
Titration format: Full-volume titration
Maximum titer: 20 mL
Waiting time before titration: 30 seconds
Titration direction: Automatic (Control Parameters)

End point judgment potential: 30 dE
End point judgment potential value: 50 dE/dmL
End point detection judgment: Not set
Control speed mode: Standard
Gain: 1
Data sampling potential: 4 mV
Data sampling titer: 0.1 mL (Main Test)

1.00 g of the measurement sample was accurately weighed into a 250 mL tall beaker, a mixed solution of 70.0 g of toluene and 30.0 g of ethanol (mass ratio 70:30, total 100.0 g) was added, and the sample was dissolved over the course of one hour. Titration was then performed with the aforementioned potassium hydroxide ethanol solution using the aforementioned potentiometric titrator.

(Blank Test)

Titration was performed by the same operations as above except that no sample was used (that is, using only 100.0 g of a mixed solution of 70.0 g of toluene and 30.0 g of ethanol).

(Calculating Acid Value)

The results were entered into the following formula to calculate the acid value.

$$A=[(C-B)\times f\times 5.611]/S$$

(In the formula, A is the acid value (mgKOH/g), B is the added amount (mL) of the potassium hydroxide ethanol solution in the blank test, C is the added amount (mL) of the potassium hydroxide ethanol solution in the main test, f is the factor of the potassium hydroxide ethanol solution, and S is the sample (g).)

(Determining pKa)

The point at which the pH change gradient is the greatest in the titration curve obtained by acid value measurement is taken as the neutralization point. The pKa is determined as follows. The pH at half the amount of 0.1 mol/L potassium hydroxide ethanol solution required up to the neutralization point is read from the titration curve, and this pH value is given as the pKa. However, the pH at the beginning of titration is given as the pKa in cases in which the acid value is less than 0.5 and the neutralization point is difficult to determine.

(Methods for Measuring Base Value and pKb of Pigment)

The base value is the number of mg of potassium hydroxide equivalent to hydrochloric acid needed to neutralize the base contained in 1 g of the sample. The base value of the pigment is measured by operations similar to those used to measure the acid value of the resin A, and specifically is measured by the following procedures.

Titration is performed using a 0.1 mol/L hydrochloric acid ethanol solution. The 0.1 mol/L hydrochloride acid is prepared in accordance with JIS K 8001-1998.

The measurement conditions for base value measurement are as follows.

Titration unit: AT-510 potentiometric titrator (Kyoto Electronics Manufacturing Co., Ltd.)

Electrodes: Composite glass electrode double-junction type (Kyoto Electronics Manufacturing Co., Ltd.)

Control software for titration unit: AT-WIN

Titration analysis software: Tview

The titration parameters and control parameters for titration are set as follows.

(Titration Parameters)

Titration mode: Blank titration

Titration format: Full-volume titration

Maximum titer: 20 mL

Waiting time before titration: 30 seconds

Titration direction: Automatic (Control Parameters)

End point judgment potential: 30 dE

End point judgment potential value: 50 dE/dmL

End point detection judgment: Not set

Control speed mode: Standard

Gain: 1

Data sampling potential: 4 mV

Data sampling titer: 0.1 mL (Main Test)

10.0 g of pigment, 200.0 g of a mixed solution of 140.0 g of toluene and 60.0 g of ethanol (mass ratio 70:30) and 250 g of 0.8 mm glass beads were placed in a pressure-resistant container, and the pigment was dispersed for 5 hours with a paint shaker (Toyo Seiki Seisaku-Sho, Ltd.). The glass beads were then removed to obtain a pigment dispersion. 100.0 g of this pigment dispersion was then accurately weighed into a tall beaker.

This was then titrated with the aforementioned hydrochloric acid ethanol solution using the aforementioned potentiometric titrator.

(Blank Test)

Titration was performed by the same operations but without the sample (that is, using only 200.0 g of a mixed solution of 140.0 g toluene and 60.0 g ethanol).

(Calculating Base Value)

The results were entered into the following formula to calculate the base value $$BV=[(C-B)\times f\times 5.611]/S$$

(In the formula, BV is the base value (mgKOH/g), B is the added amount (mL) of the hydrochloric acid ethanol solution in the blank test, C is the added amount (mL) of the hydrochloric acid ethanol solution in the main test, f is the factor of a potassium hydrochloride ethanol solution, and S is the sample (g).)

(Determining pKb)

The point at which the pH change gradient is the greatest in the titration curve obtained by base value measurement is taken as the neutralization point. The pKb is determined as follows. The pH at half the amount of 0.1 mol/L hydrochloric acid ethanol solution required up to the neutralization point is read from the titration curve, and this pH value is given as the pKb. However, the pH at the beginning of titration is given as the pKb in cases in which the base value is less than 0.1 and the neutralization point is difficult to determine.

(Method for Measuring Weight-Average Particle Diameter (D4) of Toner Particle and Toner)

The weight-average particle diameter (D4) of the toner and the like was measured using a Coulter Counter Multisizer 3 (registered trademark, Beckman Coulter, Inc.), a precise particle size distribution analyzer. Measurement was performed under the following conditions.

Effective measurement channels: 25,000

Total number of control motors: 50,000

Aperture: 100 μm

Current: 1600 μA

Gain: 2

Measurement is performed using a Kd value obtained with "standard particles 10.0 μm" (Beckman Coulter, Inc.).

The measurement data were analyzed with the dedicated software attached to the apparatus, to calculate the weight-average particle diameter (D4). The weight-average particle diameter (D4) is the "average diameter" on the analysis/volume statistical value (arithmetic average) screen when graph/vol % is set by the dedicated software.

EXAMPLES

The present invention is explained in detail below using examples, but the invention is not limited to these examples. Unless otherwise specified, "parts" (hereunder sometimes called a "pts") and "%" values in the text are all based on mass.

Pigment Manufacturing Example

A pigment was manufactured according to the methods described in Japanese Patent No. 4484171.

Manufacturing Example of Organic Dye 1 Having Basic Segments 91.4 parts of 98% sulfuric acid, 36.7 parts of 25% fuming sulfuric acid, 6.3 parts of diethylamine and 2.8 parts of 92% paraformaldehyde were loaded at 40° C. into a reaction container equipped with a stirring blade, condenser, a thermometer and a nitrogen introduction tube. This was stirred for 30 minutes at 40° C., after which 8.0 parts of copper phthalocyanine were slowly added. After addition, the reaction solution was warmed, and a reaction was performed for 5 hours at 80° C. After completion of the reaction, the reaction solution was cooled to room temperature and transferred to 750 parts of water, and the slurry was filtered out, water washed and dried to obtain an organic dye 1 having diethylaminomethyl groups.

When the resulting organic dye 1 was analyzed by NMR, an average of 2.1 diethylaminomethyl groups were found to have been introduced. The physical properties of the organic dye 1 are shown in Table 1.

Manufacturing Examples of Organic Dyes 2 to 9

The organic dyes 2 to 9 shown in Table 1 below were manufactured by methods similar to those used in the manufacturing example of organic dye 1 except that the structure of the amine compound and the base structure were changed appropriately.

TABLE 1

| Organic dye No. | Structure | y (average number) |
|---|---|---|
| 1 | 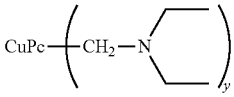 | 2.1 |
| 2 | 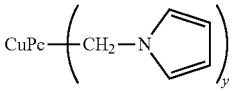 | 2.5 |
| 3 | 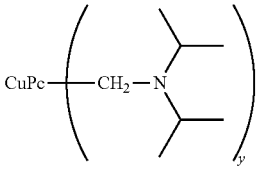 | 2.6 |
| 4 | 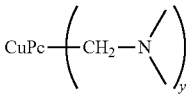 | 2.0 |
| 5 | 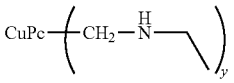 | 1.9 |
| 6 | $CuPc-(CH_2-NH_2)_y$ | 1.7 |
| 7 | 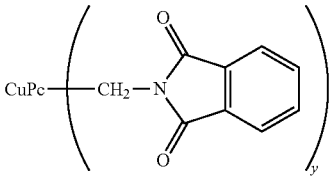 | 2.1 |
| 8 | $CuPc-(SO_3H)_y$ | 1.7 |
| 9 | 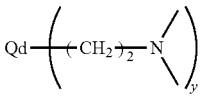 | 2.2 |

In Table 1, CuPc represents copper phthalocyanine and Qd represents dimethylquinacridone.

Manufacturing Example of Pigment B1

2 parts of the organic dye 1 were added to 100 parts of untreated pigment (C. I. Pigment Blue 15:3), and mixed by shaking for 24 hours to prepare a pigment B1. The physical properties of the resulting pigment B1 are shown in Table 2.

Manufacturing Examples of Pigments B2 to B15

The pigments B2 to B15 shown in Table 2 below were manufactured by methods similar to those used in manufacturing the pigment B1 except that the type of organic dye, the type of untreated pigment and the mixing ratios were changed appropriately. The physical properties of the resulting pigments are shown in Table 2.

(Manufacture of Pigment B16)

914 parts of 98% sulfuric acid, 367 parts of 25% fuming sulfuric acid, 1.2 parts of diethylamine and 28 parts of 92% paraformaldehyde were loaded at 40° C. into a reaction container equipped with a stirring blade, condenser, a thermometer and a nitrogen introduction tube. This was stirred for 30 minutes at 40° C., after which 80 parts of copper phthalocyanine were slowly added. After addition, the reaction solution was warmed, and a reaction was performed for 5 hours at 80° C. After completion of the reaction, the reaction solution was cooled to room temperature and transferred to 7500 parts of water, and the slurry was filtered out, water washed and dried to obtain a pigment B16 having a diethylaminomethyl groups as basic functional groups. The pigment thus obtained is shown in Table 2.

TABLE 2

| Pigment No. | Type of organic dye | Type of pigment | pKb | Base value of pigment (mgKOH/g) |
|---|---|---|---|---|
| B1 | 1 | PB15:3 | 5.5 | 1.5 |
| B2 | 2 | PB15:3 | 4.4 | 1.6 |
| B3 | 3 | PB15:3 | 5.0 | 1.5 |
| B4 | 4 | PB15:3 | 5.7 | 1.6 |
| B5 | 5 | PB15:3 | 6.6 | 1.5 |
| B6 | 6 | PB15:3 | 7.4 | 1.3 |
| B7 | 7 | PB15:3 | 5.2 | 1.4 |
| B8 | 1 | PB15:3 | 5.5 | 0.5 |
| B9 | 1 | PB15:3 | 5.4 | 1.0 |
| B10 | 1 | PB15:3 | 5.5 | 2.8 |
| B11 | 1 | PB15:3 | 5.4 | 3.5 |
| B12 | 8 | PB15:3 | 2.3 | 0.0 |
| B13 | 1 | CB | 5.4 | 1.6 |
| B14 | 1 | PR122 | 5.5 | 1.5 |
| B15 | 9 | PR122 | 5.7 | 1.6 |
| B16 | (Pigment directly treated) | | 5.6 | 1.4 |

In Table 2, C. I. Pigment Blue 15:3 is shown as "PB15:3", carbon black as "CB" and C. I. Pigment Red 122 as "PR 122".

Manufacturing Example of Resin A (Synthesis Example of Compound C1)

78.6 g of 2,4-dihydroxybenzoic acid were dissolved in 400 mL of methanol, 152.0 g of potassium carbonate were added, and the mixture was heated to 60° C. A mixture of 87.9 g of 4-(chloromethyl)styrene and 100 mL of methanol was added dropwise to this reaction solution, which was then reacted for 2.5 hours at 60° C. The resulting reaction solution was cooled, filtered, and washed with methanol.

The resulting precipitate was dispersed in 1 L of water the pH of which had been adjusted to 1 with hydrochloric acid.

This was then filtered, water washed and dried at 80° C. to obtain 55.7 g of the compound C1 represented by Formula (8) below.

(Compound C1)

Formula (8)

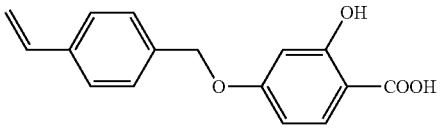

Synthesis Example of Compound C2

18 g of 2,5-dihydroxy-3-methoxybenzoic acid were dissolved in 150 mL of methanol, 36.9 g of potassium carbonate were added, and the mixture was heated to 65° C. A mixture of 18.7 g of 4-(chloromethyl)styrene and 100 mL of methanol was added dropwise to this reaction solution, which was then reacted for 3 hours at 65° C. The resulting reaction solution was cooled and filtered, and the filtrate was concentrated to obtain a coarse product.

The coarse product was dispersed in 1.5 L of pH 2 water, and extracted by addition of ethyl acetate. This was then water washed and dried with magnesium sulfate, and the ethyl acetate was distilled off under reduced pressure to obtain a precipitate.

The resulting precipitate was hexane washed, and purified by recrystallization with toluene and ethyl acetate to obtain 20.1 g of the compound C2 represented by Formula (9) below.

(Compound C2)

Formula (9)

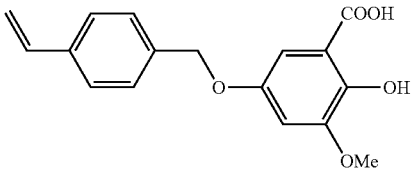

Synthesis Example of Compound C3

(Step 1)

100 g of 2,5-dihydroxybenzoic acid and 1441 g of 80% sulfuric acid were heated to 50° C. and mixed. 144 g of tert-butyl alcohol was added to this mixture, which was then stirred for 30 minutes at 50° C. A further 144 g of tert-butyl alcohol was then added to the resulting mixture, and the operation of stirring for 30 minutes was repeated three times. The reaction solution obtained by these operations was cooled to room temperature and poured slowly into 1 kg of ice water, and the resulting precipitate was filtered, water washed, and then washed with hexane. The resulting precipitate was dissolved in 200 mL of methanol, reprecipitated in 3.6 L of water, filtered, and dried at 80° C. to obtain 74.9 g of the salicylic acid intermediate represented by Formula (10) below.

Formula (10)

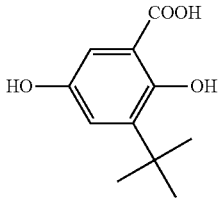

(Step 2)

The compound C3 represented by Formula (11) below was obtained as in the synthesis example of compound C2 except that 25.0 g of the salicylic acid intermediate represented by Formula (10) above was substituted for the 2,5-dihydroxy-3-methoxybenzoic acid.

(Compound C3)

Formula (11)

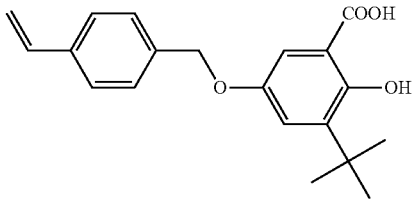

Synthesis Example of Compound C4

A salicylic acid intermediate was obtained by the same methods as in the synthesis example (Step 1) of compound C3 except that 253 g of 2-octanol were substituted for the 144 g of tert-butyl alcohol. The compound C4 represented by Formula (12) below was then obtained by the same methods as in the synthesis example (Step 2) of compound C3, but using 32 g of the resulting salicylic acid intermediate.

(Compound C4)

Formula (12)

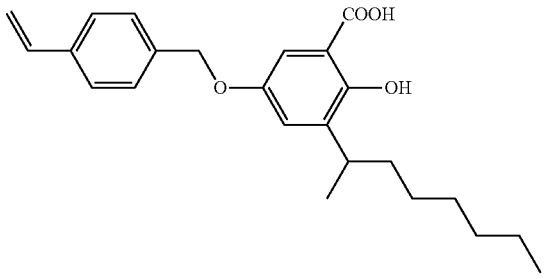

Synthesis Example of Compound C5

53.9 g of 2,3-dihydroxybenzoic acid was dissolved in 280 mL of methanol, 106 g of $K_2CO_3$ were added, and the mixture was stirred for 30 minutes at 65° C. 61.7 g of 4-chloromethylstyrene were added dropwise over the course of 1 hour. After being reacted for 3 hours under reflux, this was cooled to room temperature, and the precipitate was filtered out and washed with methanol. The methanol in the resulting methanol solution was removed under reduced pressure to obtain a brown semi-solid. This brown semi-solid was dispersed in a mixture of ethyl acetate and water, and adjusted to pH 1 with hydrochloric acid. The ethyl acetate layer was washed with saturated saline and dried with magnesium sulfate, and the solvent was removed under reduced pressure to obtain 124.3 g of a light yellow solid. This light yellow solid was recrystallized in toluene to obtain 54.5 g of the compound C5 represented by Formula (13) below.

(Compound C5)

Formula (13)

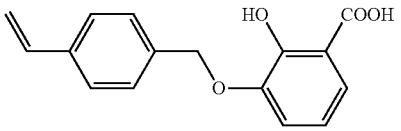

Synthesis Example of Compound C6

The compound C6 represented by Formula (14) below was obtained by the methods described in Japanese Patent Application Laid-open No. S63-270060.

(Compound C6)

Formula (14)

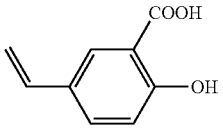

(Compound C7)

4-vinylbenzylamine was used as compound C7.

Manufacturing Example of Resin A1

60.0 parts of toluene were loaded into a reaction container equipped with a stirring blade, a condenser, a thermometer and a nitrogen introduction tube, and refluxed in a flow of nitrogen.

Next, the following raw materials and solvents were mixed to prepare a monomer mixture.

| | |
|---|---|
| Styrene | 100.0 pts |
| Compound C1 | 8.6 pts |
| Stearyl methacrylate | 25.3 pts |
| Toluene | 60.0 pts |

10.0 parts of t-butyl peroxyisopropyl monocarbonate (75% hydrogencarbonate solvent dilution) as a polymerization initiator were mixed with this monomer mixture, which was then added dropwise to the previous reaction container over the course of 30 minutes. This was stirred at 125° C., and cooled to room temperature once the desired molecular weight had been obtained. The resulting polymer-containing composition was added dropwise for 10 minutes with stirring to a mixture of 1400 parts of methanol and 10 parts of acetone, to precipitate and crystallize a resin composition.

The resulting resin composition was filtered, and rinsed twice with 200 parts of methanol. The resulting resin powder was dried for 10 hours at 60° C. under reduced pressure to obtain a resin A1. The resulting resin A1 had a hydrophobic parameter HPA of 0.78, a weight-average molecular weight (Mw) of 32,000, an acid value of 14.3 mgKOH/g, and a pKa of 7.3. The physical properties of the resin A1 are shown in Table 4.

Manufacturing Examples of Resins A2 to A25

Resins A2 to A25 were manufactured by methods similar to those of the manufacturing example of resin A1, except that the types and amounts (shown as molar parts) of the monomers were changed as shown in Table 3. The physical properties of each resin A are shown in Table 4. The n values in Formula (7) above are n=3 (butyl methacrylate), n=17 (stearyl methacrylate) and n=21 (behenyl methacrylate).

TABLE 3

| | Compound C | | Styrene | Stearyl methacrylate | Butyl methacrylate | Behenyl methacrylate |
|---|---|---|---|---|---|---|
| Resin A No. | Type | Molar parts | (molar parts) | (molar parts) | (molar parts) | (molar parts) |
| A1 | C1 | 3.0 | 90.0 | 7.0 | — | — |
| A2 | C1 | 3.0 | 87.0 | — | 10.0 | — |
| A3 | C1 | 3.0 | 91.0 | — | — | 6.0 |
| A4 | C1 | 3.0 | 90.0 | 7.0 | — | — |
| A5 | C1 | 3.0 | 90.0 | 7.0 | — | — |
| A6 | C1 | 3.0 | 90.0 | 7.0 | — | — |
| A7 | C1 | 3.0 | 90.0 | 7.0 | — | — |
| A8 | C2 | 3.0 | 90.0 | 7.0 | — | — |
| A9 | C3 | 3.0 | 90.0 | 7.0 | — | — |
| A10 | C3 | 3.0 | 87.0 | 10.0 | — | — |
| A11 | C3 | 3.0 | 82.0 | 15.0 | — | — |
| A12 | C4 | 3.0 | 90.0 | 7.0 | — | — |
| A13 | C5 | 3.0 | 90.0 | 7.0 | — | — |
| A14 | C6 | 5.0 | 81.0 | 4.0 | — | — |
| A15 | C6 | 5.0 | 81.0 | 4.0 | — | — |
| A16 | C6 | 3.0 | 90.0 | 7.0 | — | — |
| A17 | C1 | 0.5 | 92.5 | 7.0 | — | — |
| A18 | C1 | 1.0 | 92.0 | 7.0 | — | — |
| A19 | C1 | 2.0 | 91.0 | 7.0 | — | — |
| A20 | C1 | 5.0 | 95.0 | — | — | — |
| A21 | C1 | 5.0 | 91.0 | 4.0 | — | — |
| A22 | C1 | 5.0 | 88.0 | 7.0 | — | — |
| A23 | C1 | 5.0 | 85.0 | 10.0 | — | — |
| A24 | C1 | 7.0 | 83.0 | 10.0 | — | — |
| A25 | C7 | 3.0 | 90.0 | 7.0 | — | — |

TABLE 4

| Resin A | Molecular weight | | | Acid value | Hydrophobic parameter |
|---|---|---|---|---|---|
| No. | Mn | Mw | pKa | (mgKOH/g) | HPA |
| A1 | 14000 | 32000 | 7.3 | 14.3 | 0.78 |
| A2 | 12000 | 30000 | 7.2 | 13.8 | 0.66 |
| A3 | 16000 | 31000 | 7.3 | 14.2 | 0.80 |
| A4 | 3000 | 8000 | 6.9 | 14.6 | 0.77 |
| A5 | 4000 | 12000 | 7.1 | 14.2 | 0.78 |
| A6 | 21000 | 51000 | 7.5 | 14.4 | 0.77 |
| A7 | 31000 | 74000 | 7.5 | 14.3 | 0.78 |
| A8 | 12000 | 29000 | 8.1 | 13.1 | 0.78 |
| A9 | 13000 | 31000 | 7.3 | 13.6 | 0.81 |
| A10 | 12000 | 29000 | 7.4 | 13.2 | 0.88 |
| A11 | 10000 | 28000 | 7.4 | 12.1 | 0.94 |
| A12 | 11000 | 28000 | 7.3 | 12.9 | 0.82 |
| A13 | 12000 | 32000 | 7.6 | 14.0 | 0.78 |
| A14 | 3000 | 8000 | 5.7 | 24.2 | 0.50 |
| A15 | 11000 | 30000 | 6.7 | 24.1 | 0.54 |
| A16 | 12000 | 28000 | 6.6 | 14.7 | 0.76 |

TABLE 4-continued

| Resin A | Molecular weight | | | Acid value | Hydrophobic parameter |
|---|---|---|---|---|---|
| No. | Mn | Mw | pKa | (mgKOH/g) | HPA |
| A17 | 14000 | 30000 | 7.1 | 2.5 | 0.90 |
| A18 | 12000 | 30000 | 7.1 | 5.1 | 0.88 |
| A19 | 14000 | 31000 | 7.4 | 9.6 | 0.81 |
| A20 | 13000 | 29000 | 7.2 | 24.5 | 0.44 |
| A21 | 13000 | 28000 | 7.2 | 24.5 | 0.57 |
| A22 | 14000 | 31000 | 7.3 | 24.1 | 0.68 |
| A23 | 13000 | 31000 | 7.4 | 23.6 | 0.74 |
| A24 | 12000 | 31000 | 7.3 | 35.3 | 0.65 |
| A25 | 4000 | 9000 | 9.8 | 0.0 | 0.76 |

Manufacturing Example of Toner 1

| | |
|---|---|
| Styrene | 162.0 pts |
| Pigment B1 | 36.0 pts |
| Resin A1 | 3.6 pts |

These materials were introduced into an attritor (Nippon Coke & Engineering Co., Ltd.), and stirred for 180 minutes at 250 rpm, 25° C. with zirconia beads (180 pts) with a radius of 2.5 mm to prepare a master batch dispersion (MB) 1.

| | |
|---|---|
| Master batch dispersion (MB) 1 | 151.2 pts |
| Styrene | 163.4 pts |
| n-butyl acrylate | 95.0 pts |
| Hydrocarbon wax (HNP-9, Nippon Seiro Co., Ltd.) | 27.0 pts |
| Polyester resin 1 (Polycondensate of 30:20:30:20 terephthalic acid:isophthalic acid:bisphenol A propylene oxide 2-mol adduct:bisphenol A ethylene oxide 2-mol adduct, acid value 7.5 mgKOH/g, glass transition temperature Tg 74° C., Mw 12,000, Mn 4000). | 13.5 pts |

These materials were mixed and heated to 65° C., and uniformly dissolved and dispersed for 60 minutes at 3500 rpm with a T.K. HOMOMIXER (Tokushu Kika Kogyo Co., Ltd.) to obtain a toner composition solution. Meanwhile, 480.0 parts of a 0.1 mol/L aqueous $Na_3PO_4$ solution were added to 1000.0 parts of ion-exchange water in a 2 liter 4-necked flask equipped with a T.K. HOMOMIXER, and heated to 60° C. with the T.K. HOMOMIXER adjusted to 10,000 rpm. 71.9 parts of a 1.0 mol/L aqueous $CaCl_2$ solution and 3.9 parts of 10% hydrochloric acid were then gradually added to obtain an aqueous medium containing a calcium phosphate compound.

Next, 30.4 parts of a 75% toluene solution of the polymerization initiator 1,1,3,3-tetramethylbutylperoxy-2-ethylhexanoate were dissolved in the toner composition solution, thoroughly mixed, and then added to the previous aqueous medium. This was stirred for 10 minutes at 10,000 rpm in the T.K. HOMOMIXER at 65° C. in a $N_2$ atmosphere to granulate particles of a polymerizable monomer composition. This was then warmed to 75° C. while being stirred with a paddle stirring blade, and polymerized for 5 hours. After being warmed to 85° C. at a rate of 1° C./min, the composition was reacted for 1 hour, and the polymerization reaction was terminated.

Residual monomers in the toner particles were then removed under reduced pressure, and the aqueous medium was cooled to obtain a toner particle dispersion.

Hydrochloric acid was added to reduce the pH of the toner particle dispersion to 1.4, and the dispersion was stirred for 1 hour to dissolve the calcium phosphate compound. Solid-liquid separation was then performed under 0.4 MPa of pressure in a pressure filter unit to obtain a toner cake. Ion-exchange water was then added until the pressure filter unit was full, and the toner was washed under 0.4 MPa pressure. This washing operation was repeated three times, and the product was dried to obtain a toner particle.

1.5 parts of hydrophobic silica fine particles that had been surface treated with hexamethyldisilazane (average particle diameter of primary particles: 10 nm) were added to 100 parts of the toner particle, and mixed for 300 seconds in an FM mixer (Nippon Coke & Engineering Co., Ltd.) to obtain a toner 1. This manufacturing method is called manufacturing method A.

Manufacturing Examples of Toners 2-41 and Comparative Toners 1 and 2

Toners 2 to 41 and Comparative toners 1 and 2 were manufactured by manufacturing method A as in the manufacturing example of toner 1 except that the types and amounts of the various raw materials were changed as shown in Table 5-1 and Table 5-2.

TABLE 5-1

| | Toner particle composition | | | | | | | | | | | |
|---|---|---|---|---|---|---|---|---|---|---|---|---|
| | MB1 | | | | | | | | | | | |
| Toner No. | Styrene (pts) | Pigment (pts) | | Resin A (pts) | | MB1 (pts) | Styrene (pts) | Butyl acrylate (pts) | Polyester resin 1 (pts) | Release agent (pts) | | Initiator |
| 1 | 162.0 | B1 | 36.0 | A1 | 3.6 | 151.2 | 163.4 | 95.0 | 13.5 | HNP-9 | 27.0 | 30.4 |
| 2 | 162.0 | B2 | 36.0 | A1 | 3.6 | 151.2 | 163.4 | 95.0 | 13.5 | HNP-9 | 27.0 | 30.4 |
| 3 | 162.0 | B3 | 36.0 | A1 | 3.6 | 151.2 | 163.4 | 95.0 | 13.5 | HNP-9 | 27.0 | 30.4 |
| 4 | 162.0 | B4 | 36.0 | A1 | 3.6 | 151.2 | 163.4 | 95.0 | 13.5 | HNP-9 | 27.0 | 30.4 |
| 5 | 162.0 | B5 | 36.0 | A1 | 3.6 | 151.2 | 163.4 | 95.0 | 13.5 | HNP-9 | 27.0 | 30.4 |
| 6 | 162.0 | B7 | 36.0 | A1 | 3.6 | 151.2 | 163.4 | 95.0 | 13.5 | HNP-9 | 27.0 | 30.4 |
| 7 | 162.0 | B15 | 36.0 | A1 | 3.6 | 151.2 | 163.4 | 95.0 | 13.5 | HNP-9 | 27.0 | 30.4 |

TABLE 5-1-continued

| | MB1 | | | | | Toner particle composition | | | | | | |
|---|---|---|---|---|---|---|---|---|---|---|---|---|
| Toner No. | Styrene (pts) | Pigment (pts) | | Resin A (pts) | | MB1 (pts) | Styrene (pts) | Butyl acrylate (pts) | Polyester resin 1 (pts) | Release agent (pts) | | Initiator |
| 8 | 162.0 | B1 | 36.0 | A2 | 3.6 | 151.2 | 163.4 | 95.0 | 13.5 | HNP-9 | 27.0 | 30.4 |
| 9 | 162.0 | B1 | 36.0 | A3 | 3.6 | 151.2 | 163.4 | 95.0 | 13.5 | HNP-9 | 27.0 | 30.4 |
| 10 | 162.0 | B2 | 36.0 | A4 | 3.6 | 151.2 | 163.4 | 95.0 | 13.5 | HNP-9 | 27.0 | 30.4 |
| 11 | 162.0 | B2 | 36.0 | A5 | 3.6 | 151.2 | 163.4 | 95.0 | 13.5 | HNP-9 | 27.0 | 30.4 |
| 12 | 162.0 | B2 | 36.0 | A6 | 3.6 | 151.2 | 163.4 | 95.0 | 13.5 | HNP-9 | 27.0 | 30.4 |
| 13 | 162.0 | B2 | 36.0 | A7 | 3.6 | 151.2 | 163.4 | 95.0 | 13.5 | HNP-9 | 27.0 | 30.4 |
| 14 | 162.0 | B7 | 36.0 | A9 | 3.6 | 151.2 | 163.4 | 95.0 | 13.5 | HNP-9 | 27.0 | 30.4 |
| 15 | 162.0 | B7 | 36.0 | A10 | 3.6 | 151.2 | 163.4 | 95.0 | 13.5 | HNP-9 | 27.0 | 30.4 |
| 16 | 162.0 | B7 | 36.0 | A11 | 3.6 | 151.2 | 163.4 | 95.0 | 13.5 | HNP-9 | 27.0 | 30.4 |
| 17 | 162.0 | B1 | 36.0 | A12 | 3.6 | 151.2 | 163.4 | 95.0 | 13.5 | HNP-9 | 27.0 | 30.4 |
| 18 | 162.0 | B1 | 36.0 | A13 | 3.6 | 151.2 | 163.4 | 95.0 | 13.5 | HNP-9 | 27.0 | 30.4 |
| 19 | 162.0 | B1 | 36.0 | A16 | 3.6 | 151.2 | 163.4 | 95.0 | 13.5 | HNP-9 | 27.0 | 30.4 |
| 20 | 162.0 | B1 | 36.0 | A8 | 3.6 | 151.2 | 163.4 | 95.0 | 13.5 | HNP-9 | 27.0 | 30.4 |
| 21 | 162.0 | B1 | 36.0 | A17 | 3.6 | 151.2 | 163.4 | 95.0 | 13.5 | HNP-9 | 27.0 | 30.4 |
| 22 | 162.0 | B1 | 36.0 | A18 | 3.6 | 151.2 | 163.4 | 95.0 | 13.5 | HNP-9 | 27.0 | 30.4 |
| 23 | 162.0 | B1 | 36.0 | A19 | 3.6 | 151.2 | 163.4 | 95.0 | 13.5 | HNP-9 | 27.0 | 30.4 |

TABLE 5-2

| | MB1 | | | | | Toner particle composition | | | | | | |
|---|---|---|---|---|---|---|---|---|---|---|---|---|
| Toner No. | Styrene (pts) | Pigment (pts) | | Resin A (pts) | | MB1 (pts) | Styrene (pts) | Butyl acrylate (pts) | Polyester resin 1 (pts) | Release agent (pts) | | Initiator |
| 24 | 162.0 | B1 | 36.0 | A23 | 3.6 | 151.2 | 163.4 | 95.0 | 13.5 | HNP-9 | 27.0 | 30.4 |
| 25 | 162.0 | B1 | 36.0 | A22 | 3.6 | 151.2 | 163.4 | 95.0 | 13.5 | HNP-9 | 27.0 | 30.4 |
| 26 | 162.0 | B1 | 36.0 | A24 | 3.6 | 151.2 | 163.4 | 95.0 | 13.5 | HNP-9 | 27.0 | 30.4 |
| 27 | 162.0 | B8 | 36.0 | A1 | 3.6 | 151.2 | 163.4 | 95.0 | 13.5 | HNP-9 | 27.0 | 30.4 |
| 28 | 162.0 | B9 | 36.0 | A1 | 3.6 | 151.2 | 163.4 | 95.0 | 13.5 | HNP-9 | 27.0 | 30.4 |
| 29 | 162.0 | B10 | 36.0 | A1 | 3.6 | 151.2 | 163.4 | 95.0 | 13.5 | HNP-9 | 27.0 | 30.4 |
| 30 | 162.0 | B11 | 36.0 | A1 | 3.6 | 151.2 | 163.4 | 95.0 | 13.5 | HNP-9 | 27.0 | 30.4 |
| 31 | 162.0 | B11 | 36.0 | A23 | 3.6 | 151.2 | 163.4 | 95.0 | 13.5 | HNP-9 | 27.0 | 30.4 |
| 32 | 162.0 | B10 | 36.0 | A18 | 3.6 | 151.2 | 163.4 | 95.0 | 13.5 | HNP-9 | 27.0 | 30.4 |
| 33 | 162.0 | B1 | 36.0 | A1 | 0.9 | 149.2 | 164.9 | 95.5 | 13.5 | HNP-9 | 27.0 | 30.5 |
| 34 | 162.0 | B1 | 36.0 | A1 | 1.8 | 149.9 | 164.4 | 95.3 | 13.5 | HNP-9 | 27.0 | 30.5 |
| 35 | 162.0 | B1 | 36.0 | A1 | 7.2 | 153.9 | 161.3 | 94.3 | 13.5 | HNP-9 | 27.0 | 30.2 |
| 36 | 162.0 | B1 | 36.0 | A1 | 10.8 | 156.6 | 159.3 | 93.6 | 13.5 | HNP-9 | 27.0 | 30.0 |
| 37 | 162.0 | B1 | 36.0 | A18 | 7.2 | 153.9 | 161.3 | 94.3 | 13.5 | HNP-9 | 27.0 | 30.2 |
| 38 | 162.0 | B11 | 36.0 | A1 | 7.2 | 153.9 | 161.3 | 94.3 | 13.5 | HNP-9 | 27.0 | 30.2 |
| 39 | 189.0 | B13 | 42.0 | A1 | 4.2 | 176.4 | 139.4 | 93.7 | 13.5 | HNP-9 | 27.0 | 30.4 |
| 40 | 216.0 | B14 | 48.0 | A1 | 7.2 | 203.4 | 114.1 | 92.0 | 13.5 | HNP-9 | 27.0 | 30.3 |
| 41 | 216.0 | B15 | 48.0 | A1 | 7.2 | 203.4 | 114.1 | 92.0 | 13.5 | HNP-9 | 27.0 | 30.3 |
| Comparative 1 | 162.0 | B1 | 36.0 | A14 | 3.6 | 151.2 | 163.4 | 95.0 | 13.5 | HNP-9 | 27.0 | 30.4 |
| Comparative 2 | 162.0 | B1 | 36.0 | A25 | 3.6 | 151.2 | 163.4 | 95.0 | 13.5 | HNP-9 | 27.0 | 30.4 |

Manufacturing Example of Toner 42

| | |
|---|---|
| Methylethylketone (MEK) | 144.0 pts |
| Pigment B1 | 36.0 pts |
| Resin A22 | 3.6 pts |

These materials were introduced into an attritor, and stirred for 180 minutes at 250 rpm, 25° C. with zirconia beads with a radius of 2.5 mm (180 pts) to prepare a master batch dispersion (MB) 2.

| | |
|---|---|
| Methylethylketone | 59.4 pts |
| Master batch dispersion (MB) 2 | 96.4 pts |
| Polyester resin 2 (polycondensate of 50:30:20 terephthalic acid:bisphenol A propylene oxide 2-mol adduct:hexanediol, acid value 9.5 mgKOH/g, glass transition temperature (Tg) 60° C., Mw 29,000, Mn 12,000, hydrophobic parameter 0.81) | 177.0 pts |
| Polyester resin 3 (polycondensate of 50:30:19.5:0.5 terephthalic acid:bisphenol A propylene oxide 2-mol adduct:bisphenol A ethylene oxide 2-mol adduct:trimellitic anhydride, acid value 12.5 mgKOH/g, glass transition temperature (Tg) 74° C., Mw 21,000, Mn 9000, hydrophobic parameter 0.49) | 94.5 pts |

-continued

| | |
|---|---|
| Hydrocarbon wax (HNP-9, Nippon Seiro Co., Ltd.) | 15.8 pts |
| These materials were mixed and heated to 75° C., and uniformly dissolved and dispersed for 60 minutes at 5000 rpm with a T.K. HOMOMIXER to obtain a toner composition solution. | |

Meanwhile, 480.0 parts of a 0.1 mol/L aqueous $Na_3PO_4$ solution were added to 1000.0 parts of ion-exchange water in a 2 liter 4-necked flask equipped with a T.K. HOMOMIXER, and heated to 60° C. with the T.K. HOMOMIXER adjusted to 10,000 rpm. 71.9 parts of a 1.0 mol/L aqueous $CaCl_2$ solution and 3.9 parts of 10% hydrochloric acid were then gradually added to obtain an aqueous medium containing a calcium phosphate compound.

Next, the toner composition solution was added to this aqueous medium. This was stirred for 30 minutes at 13,000 rpm in a T.K. HOMOMIXER at 75° C. to granulate particles of a toner composition solution. This was then warmed to 85° C. while being stirred with a paddle stirring blade, and distilled for 5 hours at normal pressure. Residual solvent was further distilled off under reduced pressure, and the aqueous medium was cooled to obtain a toner particle dispersion.

Hydrochloric acid was added to reduce the pH of the toner particle dispersion to 1.4, and the dispersion was stirred for 1 hour to dissolve the calcium phosphate compound. Solid-liquid separation was then performed under 0.4 MPa of pressure in a pressure filter unit to obtain a toner cake. Ion-exchange water was then added until the pressure filter unit was full, and the toner was washed under 0.4 MPa pressure. This washing operation was repeated three times, and the product was dried to obtain a toner particle 42.

As in the case of the toner particle 1, hydrophobic silica fine particles that had been surface treated with hexamethyldisilazane were added to the resulting toner particle 42, to obtain a toner 42. This manufacturing method is called manufacturing method B.

Manufacturing Example of Toner 43

A toner 43 was manufactured by manufacturing method B as in the manufacturing example of toner 42 except that the types and amounts of the raw materials were changed appropriately as shown in Table 6.

Manufacturing Example of Toner 44

| | |
|---|---|
| Methylethylketone (MEK) | 120.0 pts |
| Pigment B1 | 30.0 pts |
| Resin A23 | 6.0 pts |

These materials were introduced into an attritor, and stirred for 180 minutes at 250 rpm, 25° C. with zirconia beads with a radius of 2.5 mm (180 pts) to prepare a master batch dispersion (MB) 3.

235.2 parts of the polyester resin 2 were loaded into a twin-screw kneader (PCM-30, Ikegai Corp.) set to 120° C., and 124.8 parts of the master batch dispersion (MB) 3 were then added in three additions, and kneaded to remove the solvent. 120.0 parts of the polyester resin 3 and 16.0 parts of a hydrocarbon wax (HNP-9, Nippon Seiro Co., Ltd.) were then added, and the mixture was kneaded.

The resulting kneaded material was cooled, and coarsely crushed to 1 mm or less in a hammer mill to produce a coarsely crushed material.

The resulting coarsely crushed material was then pulverized with a mechanical pulverizer (T-250, Turbo Kogyo Co., Ltd.). It was then classified with a rotary classifier (200 TSP, Hosokawa Micron Corporation) to obtain a toner particle 44. For the operating conditions of the rotary classifier (200 TSP, Hosokawa Micron Corporation), the classification rotor speed was 50.0 $s^{-1}$. The resulting toner particle had a weight-average particle diameter (D4) of 6.0 μm.

As in the case of the toner particle 1, hydrophobic silica fine particles that had been surface treated with hexamethyldisilazane were added to the resulting toner particle 44, to obtain a toner 44. This manufacturing method is called manufacturing method C.

Manufacturing Examples of Toners 45-51 and Comparative Toner 3-6

Toners 45 to 51 and comparative toners 3 to 6 were manufactured by manufacturing method C as in the manufacturing example of toner 44 except that the types and amounts of the raw materials were changed appropriately as shown in Table 7.

The physical properties of the manufactured toners are shown in Table 8.

TABLE 6

| | MB2 | | | Toner particle composition | | | | | | |
|---|---|---|---|---|---|---|---|---|---|---|
| Toner No. | MEK (pts) | Pigment (pts) | Resin A (pts) | MEK (pts) | MB2 (pts) | Other resin (pts) | | Release agent (pts) | | |
| 42 | 144.0 | B1 36.0 | A22 3.6 | 59.4 | 96.4 | Polyester resin 2 | 177.0 | Polyester resin 3 | 94.5 | HNP-9 15.8 |
| 43 | 144.0 | B1 36.0 | A23 3.6 | 59.4 | 96.4 | Polyester resin 2 | 177.0 | Polyester resin 3 | 94.5 | HNP-9 15.8 |

TABLE 7

| Toner No. | MB3 MEK (pts) | MB3 Pigment (pts) | | MB3 Resin A (pts) | | MB3 (pts) | Polyester resin 2 (pts) | Polyester resin 3 (pts) | Release agent (pts) | |
|---|---|---|---|---|---|---|---|---|---|---|
| 44 | 120.0 | B1 | 30.0 | A23 | 6.0 | 124.8 | 235.2 | 120.0 | HNP-9 | 16.0 |
| 45 | 120.0 | B7 | 30.0 | A23 | 6.0 | 124.8 | 235.2 | 120.0 | HNP-9 | 16.0 |
| 46 | 120.0 | B7 | 30.0 | A22 | 6.0 | 124.8 | 235.2 | 120.0 | HNP-9 | 16.0 |
| 47 | 120.0 | B7 | 30.0 | A21 | 6.0 | 124.8 | 235.2 | 120.0 | HNP-9 | 16.0 |
| 48 | 120.0 | B7 | 30.0 | A20 | 6.0 | 124.8 | 235.2 | 120.0 | HNP-9 | 16.0 |
| 49 | 120.0 | B5 | 30.0 | A20 | 6.0 | 124.8 | 235.2 | 120.0 | HNP-9 | 16.0 |
| 50 | 120.0 | B7 | 30.0 | A16 | 6.0 | 124.8 | 235.2 | 120.0 | HNP-9 | 16.0 |
| 51 | 120.0 | B7 | 30.0 | A15 | 6.0 | 124.8 | 235.2 | 120.0 | HNP-9 | 16.0 |
| Comparative3 | 120.0 | B6 | 30.0 | A20 | 6.0 | 124.8 | 235.2 | 120.0 | HNP-9 | 16.0 |
| Comparative4 | 120.0 | B12 | 30.0 | A20 | 6.0 | 124.8 | 235.2 | 120.0 | HNP-9 | 16.0 |
| Comparative5 | 120.0 | B7 | 30.0 | A14 | 6.0 | 124.8 | 235.2 | 120.0 | HNP-9 | 16.0 |
| Comparative6 | 120.0 | B7 | 30.0 | A25 | 6.0 | 124.8 | 235.2 | 120.0 | HNP-9 | 16.0 |

TABLE 8

| Toner No. | Manufacturing method | Resin A Type | Resin A Pts per 100 pts of pigment | Resin A pKa | Resin A Acid value (mg KOH/g) | Resin A Mw | Pigment Type | Pigment Content (mass %) in toner particle | Pigment pKb | Pigment Base value (mg KOH/g) |
|---|---|---|---|---|---|---|---|---|---|---|
| 1 | A | A1 | 10.0 | 7.3 | 14.3 | 32000 | B1 | 6.0 | 5.5 | 1.5 |
| 2 | A | A1 | 10.0 | 7.3 | 14.3 | 32000 | B2 | 6.0 | 4.4 | 1.6 |
| 3 | A | A1 | 10.0 | 7.3 | 14.3 | 32000 | B3 | 6.0 | 5.0 | 1.5 |
| 4 | A | A1 | 10.0 | 7.3 | 14.3 | 32000 | B4 | 6.0 | 5.7 | 1.6 |
| 5 | A | A1 | 10.0 | 7.3 | 14.3 | 32000 | B5 | 6.0 | 6.6 | 1.5 |
| 6 | A | A1 | 10.0 | 7.3 | 14.3 | 32000 | B7 | 6.0 | 5.2 | 1.4 |
| 7 | A | A1 | 10.0 | 7.3 | 14.3 | 32000 | B15 | 6.0 | 5.7 | 1.6 |
| 8 | A | A2 | 10.0 | 7.2 | 13.8 | 30000 | B1 | 6.0 | 5.5 | 1.5 |
| 9 | A | A3 | 10.0 | 7.3 | 14.2 | 31000 | B1 | 6.0 | 5.5 | 1.5 |
| 10 | A | A4 | 10.0 | 6.9 | 14.6 | 8000 | B2 | 6.0 | 4.4 | 1.6 |
| 11 | A | A5 | 10.0 | 7.1 | 14.2 | 12000 | B2 | 6.0 | 4.4 | 1.6 |
| 12 | A | A6 | 10.0 | 7.5 | 14.4 | 51000 | B2 | 6.0 | 4.4 | 1.6 |
| 13 | A | A7 | 10.0 | 7.5 | 14.3 | 74000 | B2 | 6.0 | 4.4 | 1.6 |
| 14 | A | A9 | 10.0 | 7.3 | 13.6 | 31000 | B7 | 6.0 | 5.2 | 1.4 |
| 15 | A | A10 | 10.0 | 7.4 | 13.2 | 29000 | B7 | 6.0 | 5.2 | 1.4 |
| 16 | A | A11 | 10.0 | 7.4 | 12.1 | 28000 | B7 | 6.0 | 5.2 | 1.4 |
| 17 | A | A12 | 10.0 | 7.3 | 12.9 | 28000 | B1 | 6.0 | 5.5 | 1.5 |
| 18 | A | A13 | 10.0 | 7.6 | 14.0 | 32000 | B1 | 6.0 | 5.5 | 1.5 |
| 19 | A | A16 | 10.0 | 6.6 | 14.7 | 28000 | B1 | 6.0 | 5.5 | 1.5 |
| 20 | A | A8 | 10.0 | 8.1 | 13.1 | 29000 | B1 | 6.0 | 5.5 | 1.5 |
| 21 | A | A17 | 10.0 | 7.1 | 2.5 | 30000 | B1 | 6.0 | 5.5 | 1.5 |
| 22 | A | A18 | 10.0 | 7.1 | 5.1 | 30000 | B1 | 6.0 | 5.5 | 1.5 |
| 23 | A | A19 | 10.0 | 7.4 | 9.6 | 31000 | B1 | 6.0 | 5.5 | 1.5 |
| 24 | A | A23 | 10.0 | 7.4 | 23.6 | 31000 | B1 | 6.0 | 5.5 | 1.5 |
| 25 | A | A22 | 10.0 | 7.3 | 24.1 | 31000 | B1 | 6.0 | 5.5 | 1.5 |
| 26 | A | A24 | 10.0 | 7.3 | 35.3 | 31000 | B1 | 6.0 | 5.5 | 1.5 |
| 27 | A | A1 | 10.0 | 7.3 | 14.3 | 32000 | B8 | 6.0 | 5.5 | 0.5 |
| 28 | A | A1 | 10.0 | 7.3 | 14.3 | 32000 | B9 | 6.0 | 5.4 | 1.0 |
| 29 | A | A1 | 10.0 | 7.3 | 14.3 | 32000 | B10 | 6.0 | 5.5 | 2.8 |
| 30 | A | A1 | 10.0 | 7.3 | 14.3 | 32000 | B11 | 6.0 | 5.4 | 3.5 |
| 31 | A | A23 | 10.0 | 7.4 | 23.6 | 31000 | B11 | 6.0 | 5.4 | 3.5 |
| 32 | A | A18 | 10.0 | 7.1 | 5.1 | 30000 | B10 | 6.0 | 5.5 | 2.8 |
| 33 | A | A1 | 2.5 | 7.3 | 14.3 | 32000 | B1 | 6.0 | 5.5 | 1.5 |
| 34 | A | A1 | 5.0 | 7.3 | 14.3 | 32000 | B1 | 6.0 | 5.5 | 1.5 |
| 35 | A | A1 | 20.0 | 7.3 | 14.3 | 32000 | B1 | 6.0 | 5.5 | 1.5 |
| 36 | A | A1 | 30.0 | 7.3 | 14.3 | 32000 | B1 | 6.0 | 5.5 | 1.5 |
| 37 | A | A18 | 20.0 | 7.1 | 5.1 | 30000 | B1 | 6.0 | 5.5 | 1.5 |
| 38 | A | A1 | 20.0 | 7.3 | 14.3 | 32000 | B11 | 6.0 | 5.4 | 3.5 |
| 39 | A | A1 | 10.0 | 7.3 | 14.3 | 32000 | B13 | 7.0 | 5.4 | 1.6 |
| 40 | A | A1 | 15.0 | 7.3 | 14.3 | 32000 | B14 | 8.0 | 5.5 | 1.5 |
| 41 | A | A1 | 15.0 | 7.3 | 14.3 | 32000 | B15 | 8.0 | 5.7 | 1.6 |
| 42 | B | A22 | 10.0 | 7.3 | 24.1 | 31000 | B1 | 6.0 | 5.5 | 1.5 |
| 43 | B | A23 | 10.0 | 7.4 | 23.6 | 31000 | B1 | 6.0 | 5.5 | 1.5 |
| 44 | C | A23 | 20.0 | 7.4 | 23.6 | 31000 | B1 | 6.0 | 5.5 | 1.5 |
| 45 | C | A23 | 20.0 | 7.4 | 23.6 | 31000 | B7 | 6.0 | 5.2 | 1.4 |

TABLE 8-continued

| Toner No. | Manufacturing method | Resin A Type | Pts per 100 pts of pigment | pKa | Acid value (mg KOH/g) | Mw | Pigment Type | Content (mass %) in toner particle | pKb | Base value (mg KOH/g) |
|---|---|---|---|---|---|---|---|---|---|---|
| 46 | C | A22 | 20.0 | 7.3 | 24.1 | 31000 | B7 | 6.0 | 5.2 | 1.4 |
| 47 | C | A21 | 20.0 | 7.2 | 24.5 | 28000 | B7 | 6.0 | 5.2 | 1.4 |
| 48 | C | A20 | 20.0 | 7.2 | 24.5 | 29000 | B7 | 6.0 | 5.2 | 1.4 |
| 49 | C | A20 | 20.0 | 7.2 | 24.5 | 29000 | B5 | 6.0 | 6.6 | 1.5 |
| 50 | C | A16 | 20.0 | 6.6 | 14.7 | 28000 | B7 | 6.0 | 5.2 | 1.4 |
| 51 | C | A15 | 20.0 | 6.7 | 24.1 | 30000 | B7 | 6.0 | 5.2 | 1.4 |
| Comparative1 | A | A14 | 10.0 | 5.7 | 24.2 | 8000 | B1 | 6.0 | 5.5 | 1.5 |
| Comparative2 | A | A25 | 10.0 | 9.8 | 0 | 9000 | B1 | 6.0 | 5.5 | 1.5 |
| Comparative3 | C | A20 | 20.0 | 7.2 | 24.5 | 29000 | B6 | 6.0 | 7.4 | 1.3 |
| Comparative4 | C | A20 | 20.0 | 7.2 | 24.5 | 29000 | B12 | 6.0 | 2.3 | 0 |
| Comparative5 | C | A14 | 20.0 | 5.7 | 24.2 | 8000 | B7 | 6.0 | 5.2 | 1.4 |
| Comparative6 | C | A25 | 20.0 | 9.8 | 0 | 9000 | B7 | 6.0 | 5.2 | 1.4 |

Examples 1-51 and Comparative Examples 1-6

The toners 1 to 51 and Comparative toners 1 to 6 were evaluated by the following evaluation methods. The evaluation results are shown in Tables 9 and 10.

(Tinting Strength Evaluation)

The original toner contained in a cartridge for a Satera LBP7700C color laser printer (Commercial product, from Canon Inc.) was removed, the interior was cleaned by air blowing, and the cartridge was filled with a test toner (150 g).

The fixing unit was also removed from the color laser printer, which was modified to allow the output of unfixed images, and to allow the image density to be adjusted with the controller. It was also modified so that it operated even when a single color cartridge was installed. The removed fixing unit was modified so that it could operate by itself, and to allow the process speed and temperature to be controlled, resulting in an external fixing unit. The cartridge was mounted in the printer, and a band image of 150 mm in width and 30 mm in height was created below a 30 mm white area on the upper part of a transfer material. The controller was set so that the toner laid-on level of the band image was 0.35 mg/cm$^2$. A4 size GF-C081 (Canon Inc., 81.4 g/m$^2$) was used as the transfer material.

10 copies of this band image were output, and fixed at 140° C. at a process speed of 210 mm/sec with the external fixing unit of the LBP7700C color laser printer.

The image density of the resulting fixed images was measured to evaluate tinting strength.

The image density was measured using an RD918 Macbeth reflection densitometer (Macbeth Co.). Relative density was measured relative to the blank part of the printout image, which had a manuscript density of 0.00, at three points on the left, center and right of each fixed image. And the arithmetic average value of 10 fixed images was calculated and evaluated. The evaluation standard was as follows.

A: Image density 1.40 or more

B: Image density at least 1.35 and less than 1.40

C: Image density at least 1.30 and less than 1.35

D: Image density less than 1.30

(Transferability Evaluation)

To evaluate transferability, a solid image was output with the toner laid-on level on the photosensitive member adjusted to 0.50 mg/cm$^2$, and the untransferred toner on the photosensitive member during solid image formation was stripped off by taping with Mylar tape. The reflectance T0 of the tape alone affixed to paper was subtracted from the reflectance T1 of the stripped tape affixed to paper to calculate the reflectance differences of each toner. The toners were evaluated as following based on the reflectance difference values. Reflectance was measured using a Tokyo Denshoku Co., Ltd. Model TC-6DS Reflectmeter.

A: Reflectance difference 2.0% or less

B: Reflectance difference more than 2.0% and not more than 5.0%

C: Reflectance difference more than 5.0% and not more than 10.0%

D: Reflectance difference more than 10.0%

TABLE 9

| Example No. | Toner No. | Tinting strength evaluation Image density | Rank | Transferability evaluation Reflectance difference (%) | Rank |
|---|---|---|---|---|---|
| 1 | 1 | 1.45 | A | 0.4 | A |
| 2 | 2 | 1.44 | A | 0.4 | A |
| 3 | 3 | 1.44 | A | 0.5 | A |
| 4 | 4 | 1.41 | A | 1.2 | A |
| 5 | 5 | 1.36 | B | 3.5 | B |
| 6 | 6 | 1.43 | A | 0.6 | A |
| 7 | 7 | 1.43 | A | 0.5 | A |
| 8 | 8 | 1.42 | A | 0.8 | A |
| 9 | 9 | 1.42 | A | 0.7 | A |
| 10 | 10 | 1.38 | B | 1.5 | A |
| 11 | 11 | 1.41 | A | 0.7 | A |
| 12 | 12 | 1.42 | A | 1.1 | A |
| 13 | 13 | 1.39 | B | 1.0 | A |
| 14 | 14 | 1.43 | A | 0.5 | A |
| 15 | 15 | 1.42 | A | 0.4 | A |
| 16 | 16 | 1.41 | A | 0.2 | A |
| 17 | 17 | 1.37 | B | 0.7 | A |
| 18 | 18 | 1.38 | B | 0.8 | A |
| 19 | 19 | 1.34 | C | 1.7 | A |
| 20 | 20 | 1.35 | B | 1.6 | A |
| 21 | 21 | 1.33 | C | 2.4 | B |
| 22 | 22 | 1.37 | B | 1.9 | A |
| 23 | 23 | 1.40 | A | 0.9 | A |
| 24 | 24 | 1.39 | B | 1.0 | A |
| 25 | 25 | 1.38 | B | 1.5 | A |
| 26 | 26 | 1.36 | B | 2.1 | B |
| 27 | 27 | 1.34 | C | 0.1 | A |
| 28 | 28 | 1.35 | B | 0.2 | A |
| 29 | 29 | 1.44 | A | 2.3 | B |

TABLE 9-continued

| Example No. | Toner No. | Tinting strength evaluation: Image density | Tinting strength evaluation: Rank | Transferability evaluation: Reflectance difference (%) | Transferability evaluation: Rank |
|---|---|---|---|---|---|
| 30 | 30 | 1.46 | A | 3.8 | B |
| 31 | 31 | 1.41 | A | 4.9 | B |

TABLE 10

| Example No. | Toner No. | Tinting strength evaluation: Image density | Tinting strength evaluation: Rank | Transferability evaluation: Reflectance difference (%) | Transferability evaluation: Rank |
|---|---|---|---|---|---|
| 32 | 32 | 1.36 | B | 3.1 | B |
| 33 | 33 | 1.34 | C | 2.3 | B |
| 34 | 34 | 1.39 | B | 1.7 | A |
| 35 | 35 | 1.43 | A | 0.9 | A |
| 36 | 36 | 1.44 | A | 1.4 | A |
| 37 | 37 | 1.38 | B | 1.6 | A |
| 38 | 38 | 1.44 | A | 2.9 | B |
| 39 | 39 | 1.43 | A | 1.2 | A |
| 40 | 40 | 1.34 | C | 1.5 | A |
| 41 | 41 | 1.36 | B | 1.7 | A |
| 42 | 42 | 1.37 | B | 3.1 | B |
| 43 | 43 | 1.41 | A | 2.1 | B |
| 44 | 44 | 1.44 | A | 3.6 | B |
| 45 | 45 | 1.44 | A | 3.6 | B |
| 46 | 46 | 1.43 | A | 4.8 | B |
| 47 | 47 | 1.44 | A | 5.4 | C |
| 48 | 48 | 1.43 | A | 6.8 | C |
| 49 | 49 | 1.37 | B | 3.8 | B |
| 50 | 50 | 1.38 | B | 7.9 | C |
| 51 | 51 | 1.41 | A | 9.8 | C |
| Comparative1 | Comparative1 | 1.29 | D | 7.3 | C |
| Comparative2 | Comparative2 | 1.23 | D | 8.8 | C |
| Comparative3 | Comparative3 | 1.35 | B | 12.3 | D |
| Comparative4 | Comparative4 | 1.36 | B | 14.1 | D |
| Comparative5 | Comparative5 | 1.35 | B | 11.5 | D |
| Comparative6 | Comparative6 | 1.36 | B | 12.3 | D |

A toner and toner manufacturing method yielding superior tinting strength and transferability can be provided by the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055247, filed, Mar. 18, 2016 which is hereby incorporated by reference herein in its entirety.

What is claimed is:

1. A toner comprising a toner particle containing:

a binder resin;

a resin A having a pKa of 6.0 to 9.0; and a pigment having a pKb of 4.0 to 7.0, the pigment being dispersed in the binder resin by the resin A, wherein the pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a potassium hydroxide ethanol solution of 0.1 mol/L, and the pKb represents a basic dissociation constant measured by preparing a pigment dispersion in which 10.0 parts by mass of the pigment, 140.0 parts by mass of toluene and 60.0 parts by mass of ethanol are mixed, and carrying out neutralization titration with a hydrochloric acid ethanol solution of 0.1 mol/L.

2. The toner according to claim 1, wherein the pigment contains an organic dye having a basic segment, and the organic dye having the basic segment has a structure represented by Formula (1)

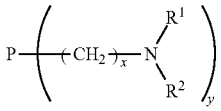

(1)

where P represents an organic dye, x is 1 or 2, y is 1 to 4, and each of $R^1$ and $R^2$ is independently a hydrogen atom, linear or branched alkyl group, or a group necessary for forming a heterocycle in which $R^1$ and $R^2$ bind together.

3. The toner according to claim 2, wherein P is an organic dye having a phthalocyanine skeleton or a quinacridone skeleton.

4. The toner according to claim 1, wherein the pigment is a pigment having a basic functional group, and the basic functional group is a group represented by Formula (2)

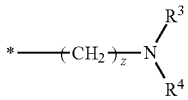

(2)

where * represents a segment binding with the pigment, z is 1 or 2, and each of $R^3$ and $R^4$ is independently a hydrogen atom, linear or branched alkyl group, or a group necessary for forming a heterocycle in which $R^3$ and $R^4$ bind together.

5. The toner according to claim 1, wherein a base value of the pigment is 0.9 to 3.0 mgKOH/g.

6. The toner according to claim 1, wherein an acid value of the resin A is 3.0 to 25.0 mgKOH/g.

7. The toner according to claim 1, wherein content of the resin A is 3.0 to 30.0 mass parts per 100 mass parts of the pigment.

8. The toner according to claim 1, wherein a hydrophobic parameter HPA of the resin A is 0.65 to 0.95, where the hydrophobic parameter HPA is a volume fraction of heptane at a point of precipitation by the resin A as measured by the addition of heptane to a solution containing 0.01 mass parts of the resin A and 1.48 mass parts of chloroform.

9. The toner according to claim 1, wherein the pKa of the resin A is 7.0 to 8.0.

10. The toner according to claim 1, wherein the resin A has a structure represented by Formula (3)

(3)

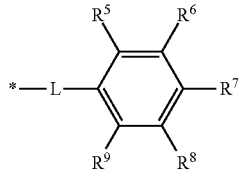

where either $R^6$ or $R^7$ is a carboxy group, while each of $R^5$, $R^6$, $R^7$, $R^8$ and $R^9$ other than the carboxy group is independently a hydrogen atom, hydroxy group, amino group, $C_{1-8}$ alkoxy group or $C_{1-8}$ alkyl group, L is a linking group represented by Formula (4), and * is a segment binding to the main chain skeleton of the resin A, (4)

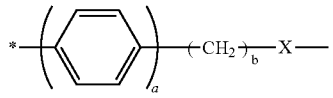

where a is 0 or 1, b is an integer of 0 to 4, X is a single bond or a group represented by —O—, —S— or —$NR^{10}$—, $R^{10}$ is a hydrogen atom or $C_{1-4}$ alkyl group, and * is a segment binding to the main chain skeleton of the resin A.

11. The toner according to claim 10, wherein the resin A has a structure represented by Formula (5)

(5)

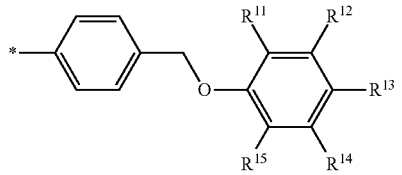

where one of $R^{12}$ and $R^{13}$ is a carboxy group while the other is a hydroxy group, and each of $R^{11}$, $R^{14}$ and $R^{15}$ is independently a hydrogen atom, hydroxy group, amino group, $C_{1-8}$ alkoxy group or $C_{1-8}$ alkyl group, and * is a segment binding to the main chain skeleton structure of the resin A.

12. The toner according to claim 1, wherein a weight-average molecular weight of the resin A is 10,000 to 75,000.

13. The toner according to claim 1, wherein the resin A has a structure represented by Formula (7)

(7)

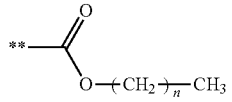

where n is an integer of 3 to 21, and ** represents a segment binding to the main chain skeleton of the resin A.

14. A method of manufacturing a toner, the toner comprising a toner particle containing a binder resin, a resin A having a pKa of 6.0 to 9.0, and a pigment having a pKb of 4.0 to 7.0, the pigment being dispersed in the binder resin by the resin A, wherein the pKa represents an acid dissociation constant measured by preparing a resin solution in which 1.0 part by mass of the resin A, 70.0 parts by mass of toluene and 30.0 parts by mass of ethanol are mixed, and carrying out neutralization titration with a potassium hydroxide ethanol solution of 0.1 mol/L, and the pKb represents a basic dissociation constant measured by preparing a pigment dispersion in which 10.0 parts by mass of the pigment, 140.0 parts by mass of toluene and 60.0 parts by mass of ethanol are mixed, and carrying out neutralization titration with a hydrochloric acid ethanol solution of 0.1 mol/L, the method comprising either step (i) or step (ii):

(i) a step of forming, in an aqueous medium, a particle comprising a polymerizable monomer composition containing the pigment, the resin A and a polymerizable monomer capable of producing the binder resin, and then polymerizing the polymerizable monomer contained in the particle of the polymerizable monomer composition;

(ii) a step of forming, in an aqueous medium, a particle comprising a resin solution obtained by dissolving or dispersing in an organic solvent the binder resin, the resin A and the pigment, and then removing the organic solvent contained in the particle of the resin solution.

15. A toner comprising a toner particle containing:

a binder resin;

a resin A; and a pigment containing an organic dye having a basic segment, the pigment being dispersed in the binder resin by the resin A, wherein the organic dye has a structure represented by Formula (1)

(1)

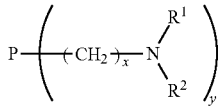

where P represents an organic dye, x is 1 or 2, y is 1 to 4, and each of $R^1$ and $R^2$ is independently a hydrogen atom, linear or branched alkyl group, or a group necessary for forming a heterocycle in which $R^1$ and $R^2$ bind together, and resin A has a structure represented by Formula (3)

(3)

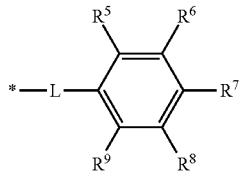

where either $R^6$ or $R^7$ is a carboxy group, while each of the $R^5$, $R^6$, $R^7$, $R^8$ and $R^9$ other than the carboxy group is independently a hydrogen atom, hydroxy group, amino group, $C_{1-8}$ alkoxy group or $C_{1-8}$ alkyl group, L is a linking group represented by the following Formula (4), and * is a segment binding to the main chain skeleton of the resin A, (4)

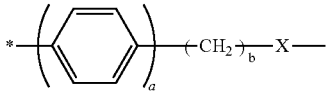

where a is 0 or 1, b is an integer of 0 to 4, X is a single bond or a group represented by —O—, —S— or —$NR^{10}$—, $R^{10}$ is a hydrogen atom or $C_{1-4}$ alkyl group, and * is a segment binding to the main chain skeleton of the resin A.

16. The toner according to claim 1, wherein the toner is a polymerized toner obtained by a suspension polymerization method in which a polymerizable monomer composition containing a polymerizable monomer for producing the binder resin, the resin A and the pigment is suspended in an aqueous medium, and the polymerizable monomer is polymerized.

17. The toner according to claim 1, wherein the toner is a pulverized toner obtained by a kneading pulverization method in which a toner-forming material containing the binder resin, the resin A and the pigment is kneaded, pulverized and sorted.

18. The toner according to claim 1, wherein the toner is a toner obtained by a dissolution suspension method in which the binder resin, the resin A and the pigment are dissolved or dispersed in an organic solvent to obtain a resin solution which is then suspended in an aqueous medium, and granulated.

19. The toner according to claim 13, where n is 17 or 21.

* * * * *